US009441907B1

(12) United States Patent
Obteshka

(10) Patent No.: US 9,441,907 B1
(45) Date of Patent: Sep. 13, 2016

(54) ADJUSTABLE PULLEY ASSEMBLY FOR A COMPOUND ARCHERY BOW

(71) Applicant: BowTech, Inc., Eugene, OR (US)

(72) Inventor: Nicholas C. Obteshka, Springfield, OR (US)

(73) Assignee: BOWTECH, INC., Eugene, OR (US)

( * ) Notice: Subject to any disclaimer, the term of this patent is extended or adjusted under 35 U.S.C. 154(b) by 0 days.

(21) Appl. No.: 14/797,072

(22) Filed: Jul. 11, 2015

(51) Int. Cl.
*F41B 5/10* (2006.01)
*F41B 5/14* (2006.01)

(52) U.S. Cl.
CPC ..... *F41B 5/105* (2013.01); *F41B 5/10* (2013.01); *F41B 5/1403* (2013.01); *Y10S 124/90* (2013.01)

(58) Field of Classification Search
CPC ..... F41B 5/105; F41B 5/10; Y10S 124/90
USPC ..... 124/25.6, 900
See application file for complete search history.

(56) References Cited

U.S. PATENT DOCUMENTS 5,678,529 A * 10/1997 Larson ..... F41B 5/105 124/25.6
5,782,229 A * 7/1998 Evans ..... F41B 5/105 124/25.6
5,975,067 A * 11/1999 Strother ..... F41B 5/10 124/25.6
6,082,347 A * 7/2000 Darlington ..... F41B 5/10 124/25.6
RE37,544 E * 2/2002 Darlington ..... F41B 5/105 124/25.6
6,516,790 B1 * 2/2003 Darlington ..... F41B 5/10 124/25.6
6,691,692 B1 * 2/2004 Adkins ..... F41B 5/10 124/25.6
6,990,970 B1 * 1/2006 Darlington ..... F41B 5/10 124/25.6
7,082,937 B1 * 8/2006 Land ..... F41B 5/105 124/25.6
7,305,979 B1 * 12/2007 Yehle ..... F41B 5/105 124/25.6
7,441,555 B1 10/2008 Larson
7,770,568 B1 * 8/2010 Yehle ..... F41B 5/10 124/25.6
7,938,109 B1 5/2011 Larson
7,971,582 B1 7/2011 Larson
8,020,544 B2 * 9/2011 McPherson ..... F41B 5/10 124/23.1
8,069,848 B1 12/2011 Larson
8,082,910 B1 * 12/2011 Yehle ..... F41B 5/105 124/23.1
8,181,638 B1 5/2012 Yehle
8,205,607 B1 * 6/2012 Darlington ..... F41B 5/105 124/23.1
8,281,774 B2 * 10/2012 Grace ..... F41B 5/10 124/25.6
8,281,775 B1 10/2012 Larson (Continued)

OTHER PUBLICATIONS

Co-owned U.S. Appl. No. 14/591,007, filed Jan. 7, 2015 in the name of Hyde et al.

(Continued)

*Primary Examiner* — Alexander Niconovich
(74) *Attorney, Agent, or Firm* — David S. Alavi

(57) ABSTRACT

A pulley assembly for a compound bow comprises a draw cable pulley, a power cable pulley attached to the draw cable pulley, and a cable deflector attached to the draw cable pulley and adjustable among multiple deflector arrangements. Movement of the cable deflector alters deflection of the power cable during the bow's draw to alter effective length of the power cable and relative synchronization of the pulley assembly with a second pulley assembly. The adjustment can be performed without using a bow press and without derigging the bow.

35 Claims, 12 Drawing Sheets

(56) References Cited

U.S. PATENT DOCUMENTS

| | | | | |
|---|---|---|---|---|
| 8,469,013 | B1 * | 6/2013 | Obteshka | F41B 5/10 124/23.1 |
| 8,683,989 | B1 * | 4/2014 | McPherson | F41B 5/105 124/25.6 |
| 8,739,769 | B1 * | 6/2014 | Obteshka | F41B 5/10 124/23.1 |
| 9,121,658 | B1 * | 9/2015 | Darlington | F41B 5/105 |
| 9,261,321 | B2 * | 2/2016 | Yi | F41B 5/105 |
| 9,347,730 | B2 * | 5/2016 | Obteshka | F41B 5/105 |
| 9,354,017 | B2 * | 5/2016 | McPherson | F41B 5/10 |
| 2009/0188482 | A1 * | 7/2009 | Strother | F41B 5/10 124/25.6 |
| 2015/0345890 | A1 * | 12/2015 | McPherson | F41B 5/105 124/25.6 |

OTHER PUBLICATIONS

Co-owned U.S. Appl. No. 15/091,572, filed Apr. 6, 2016 in the names of Eacker et al.

* cited by examiner

FIG. 7A
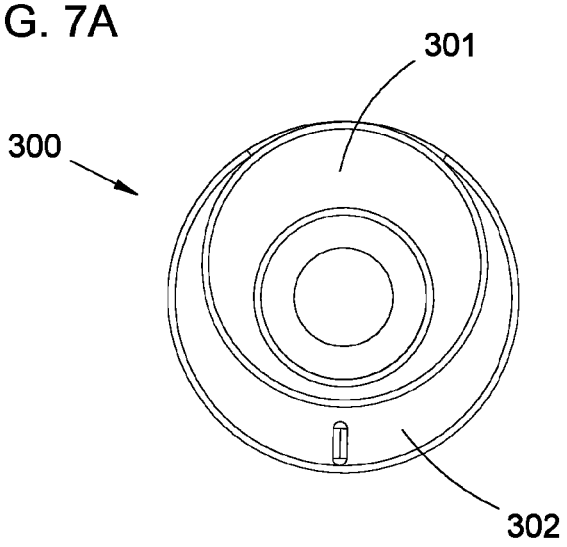
FIG. 7C
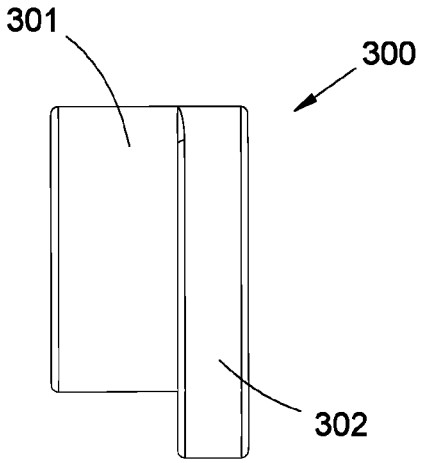
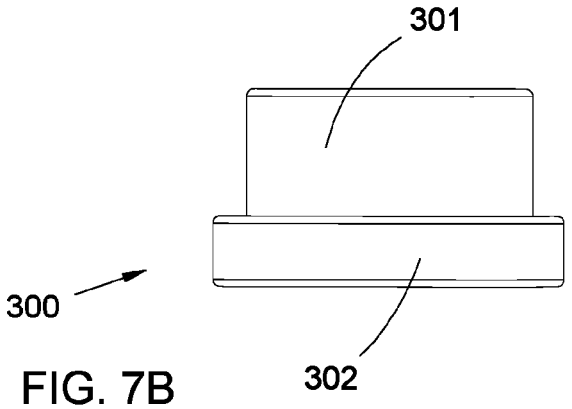
FIG. 7B
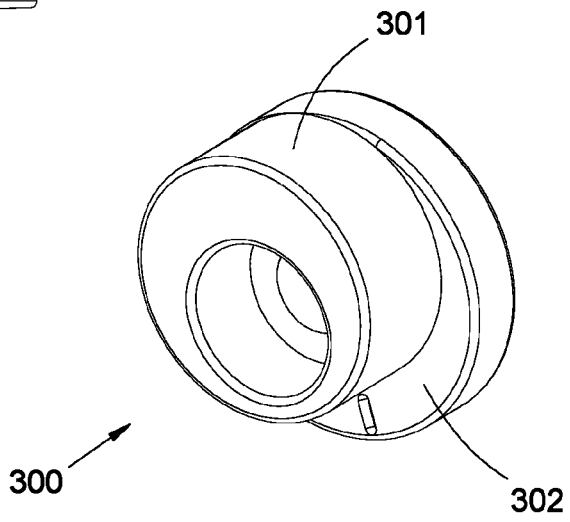
FIG. 7D

FIG. 8A
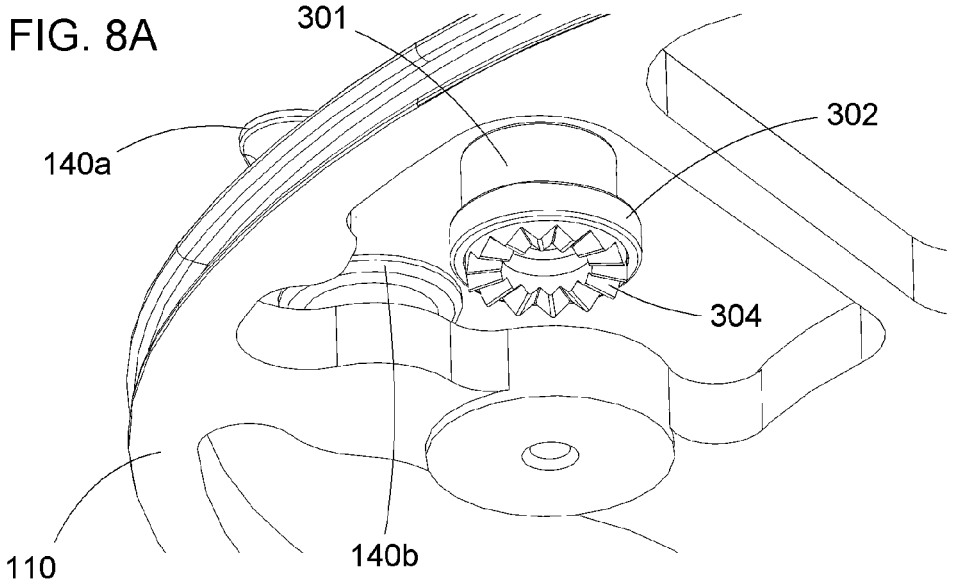
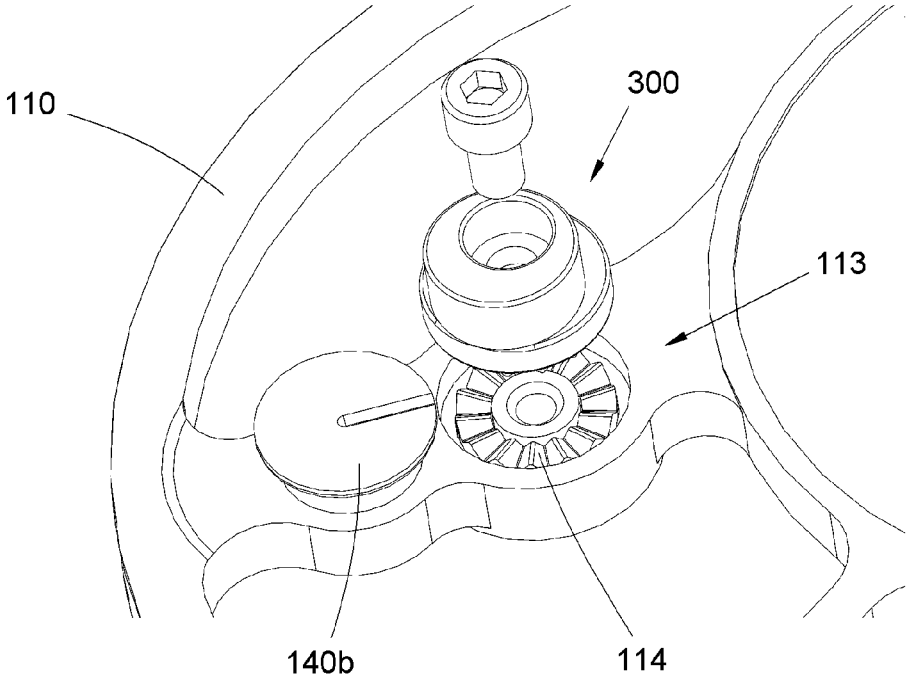
FIG. 8B

ADJUSTABLE PULLEY ASSEMBLY FOR A COMPOUND ARCHERY BOW

BACKGROUND

The field of the present invention relates to a pulley assembly for a compound archery bow. In particular, an adjustable pulley assembly is disclosed herein having an adjustable cable deflector on a draw cable pulley for providing fine adjustment of an effective length of a cable of the archery bow.

Several adjustable pulley assemblies are available for compound archery bows. Two such examples are described in: U.S. Pat. No. 8,020,544 entitled "Archery bow with force vectoring anchor" issued Sep. 20, 2011 to McPherson; and U.S. Pat. No. 8,082,910 entitled "Pulley assembly for a compound archery bow" issued Dec. 27, 2011 to Yehle.

SUMMARY

A pulley assembly for a compound archery bow comprises a draw cable pulley, a power cable pulley substantially rigidly attached to the draw cable pulley, and an adjustable cable deflector substantially rigidly attached to the draw cable pulley. The draw cable pulley is structurally arranged so as to (i) define a first pulley assembly transverse rotation axis, (ii) be mounted on a first limb of an archery bow to rotate about the first pulley assembly axis, (iii) let out from a circumferential draw cable journal of the draw cable pulley a draw cable of the archery bow when the bow is drawn and the draw cable pulley rotates about the first pulley assembly axis, and (iv) provide a power cable anchor. The power cable pulley is structurally arranged and positioned on the draw cable pulley so that (i) with the bow at brace and during an earlier phase of drawing the bow, the power cable pulley does not make contact with a power cable of the archery bow that is anchored at the power cable anchor, (ii) during a later phase of drawing the bow, a segment of the power cable that is displaced from the power cable anchor is taken up by a circumferential power cable journal of the power cable pulley, and a segment of the power cable that is immediately adjacent the power cable anchor does not make contact with the power cable pulley. One or both of the cable deflector and the draw cable pulley are structurally arranged so as to enable substantially rigid attachment of the cable deflector to the draw cable pulley in any one of a set of multiple deflector arrangements.

In any one of the multiple deflector arrangements, with the bow at brace, the cable deflector causes no lateral deflection, or only negligible lateral deflection, of the power cable. In one or more of the multiple deflector arrangements, the cable deflector is positioned and arranged so as to deflect laterally, during the later phase of drawing the bow, the adjacent segment of the power cable by a non-negligible amount relative to an undeflected power cable path between the power cable anchor and the power cable pulley, with the non-negligible amount of lateral deflection differing from an amount of lateral deflection of at least one other of the multiple deflector arrangements.

A method for adjusting the pulley assembly described above comprises moving the cable deflector from a first one of the multiple deflector arrangements and substantially rigidly attaching the cable deflector to the draw cable pulley in a second, different one of the multiple deflector arrangements, thereby altering the amount of deflection of the adjacent segment of the power cable. Differing amounts of deflection of the adjacent segment of the power cable result in (i) differing effective lengths of the power cable during the later phase of drawing the bow, and (ii) differing relative synchronizations of the pulley assembly with a second pulley assembly mounted on a second limb of the compound archery bow. The method can be performed without using a bow press and without derigging the bow.

An archery bow comprises a central riser, first and second bow limbs secured to opposing ends of the riser, first and second pulley assemblies rotatably mounted on the first and second bow limbs, respectively, a draw cable, and a power cable. One or both of the pulley assemblies are arranged as described above.

Objects and advantages pertaining to pulley assemblies for compound bows may become apparent upon referring to the example embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIGS. 7A through 7D are schematic top, front, side, and perspective views, respectively, of an example cable deflector.

FIGS. 8A and 8B illustrate schematically one example of mechanically indexed engagement of an example cable deflector with an example draw cable pulley.

It should be noted that the embodiments depicted are shown only schematically, and that not all features may be shown in full detail or in proper proportion. Certain features or structures may be exaggerated relative to others for clarity. It should be noted further that the embodiments shown are examples only, and should not be construed as limiting the scope of the present disclosure or appended claims.

DETAILED DESCRIPTION OF EMBODIMENTS

Figure 1:
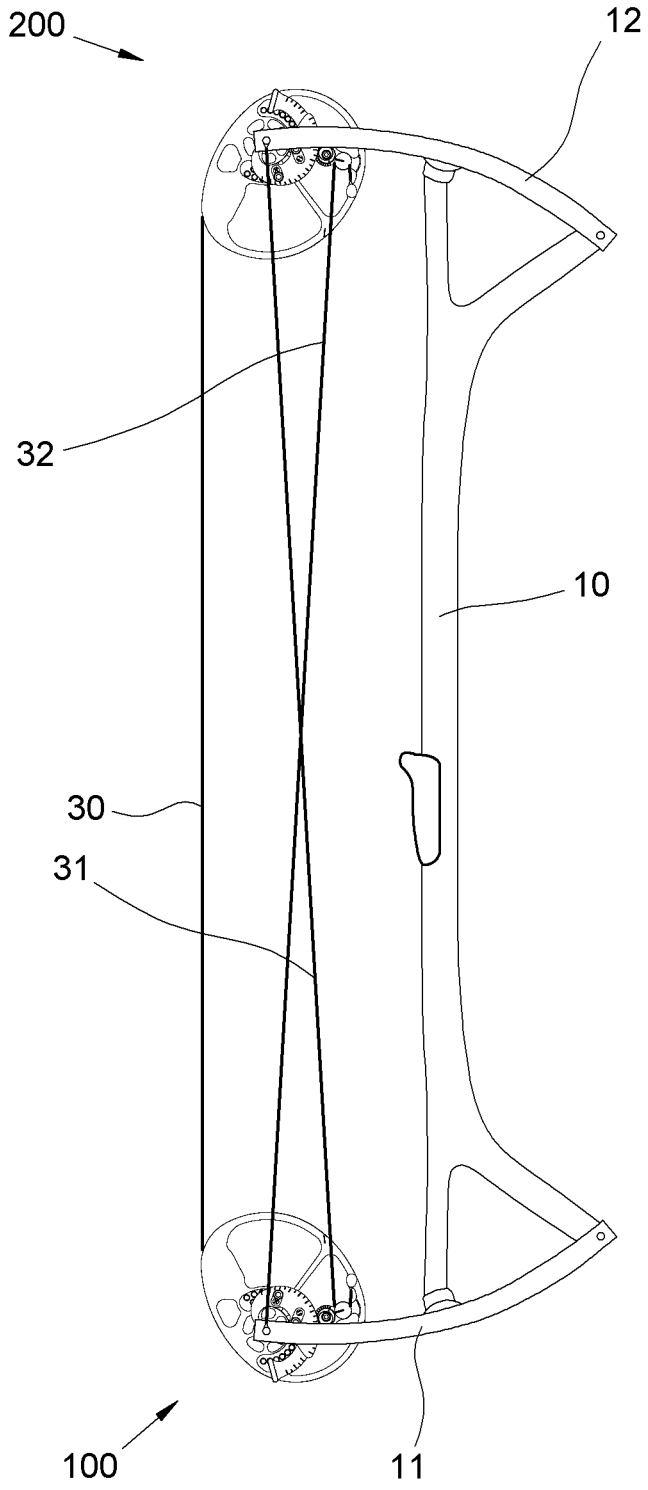
FIG. 1 illustrates schematically an example of a so-called dual cam archery bow incorporating an example inventive pulley assembly.
Figure 2:
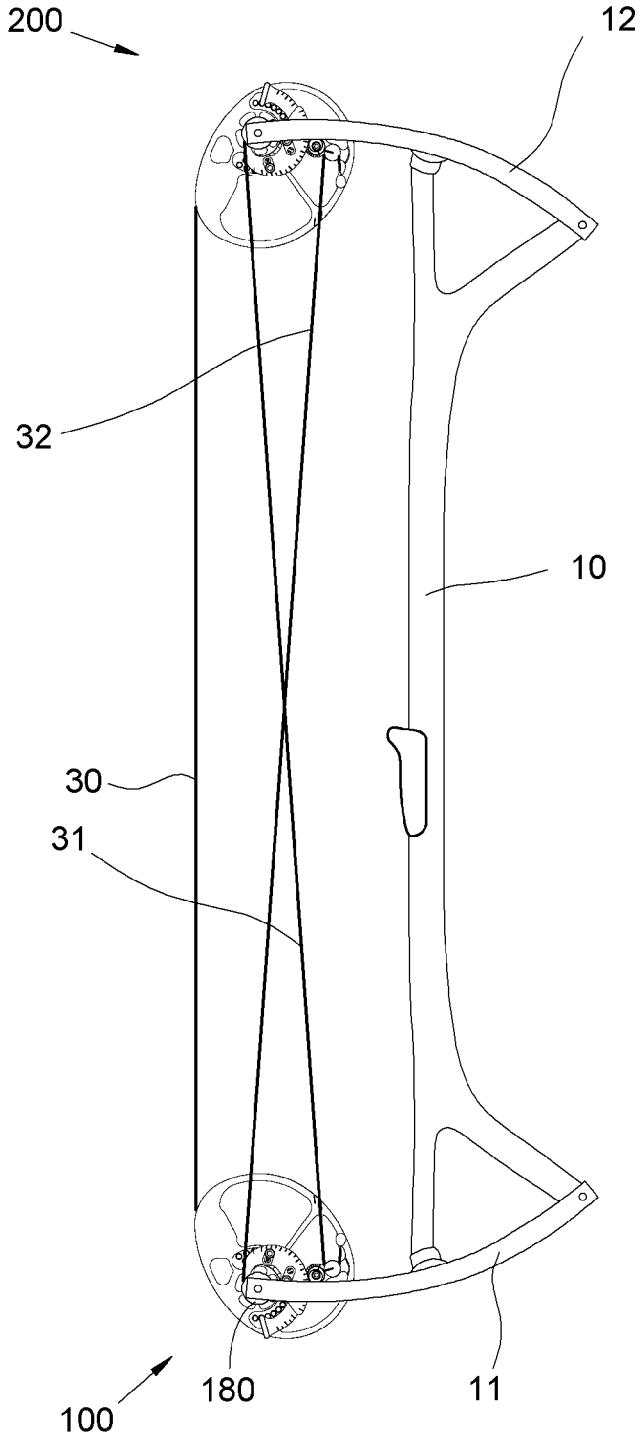
FIG. 2 illustrates schematically an example of a so-called binary cam archery bow incorporating an example inventive pulley assembly.

A compound archery bow comprises a central riser 10, first and second bow limbs 11 and 12 secured to opposing ends of the riser 10, first and second pulley assemblies 100 and 200 rotatably mounted on the first and second bow limbs 11 and 12, respectively, a draw cable 30, and a power cable 31. If the bow is a so-called dual cam bow (FIG. 1) or a so-called binary cam bow (FIG. 2), then the bow includes a second power cable 32 and the first and second pulley assemblies 100 and 200 are substantially identical or substantial mirror images of each other. Upon drawing a dual cam bow, the draw cable 30 is let out by both pulley assemblies 100 and 200, the power cable 31 (which is attached, directly or indirectly, to the second bow limb 12) is taken up by the first pulley assembly 100, and the second power cable 32 (which is attached, directly or indirectly, to the first bow limb 11) is taken up by the second pulley assembly 200. Upon drawing a binary cam bow, the draw cable 30 is let out by both pulley assemblies 100 and 200, the power cable 31 is let out by the second pulley assembly 200 and taken up by the first pulley assembly 100, and the second power cable 32 is let out by the first pulley assembly 100 and taken up by the second pulley assembly 200.

Figure 3:
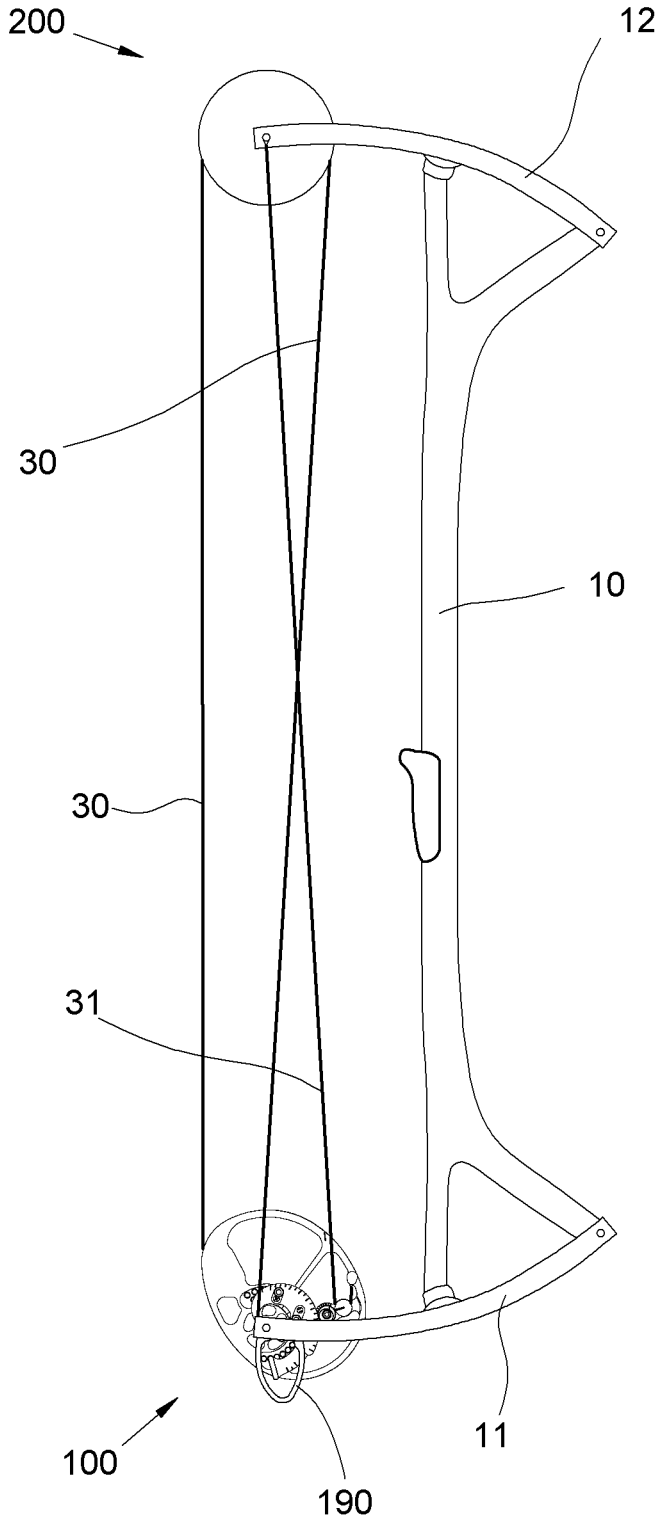
FIG. 3 illustrates schematically an example of a so-called solo cam archery bow incorporating an example inventive pulley assembly.
Figure 4:
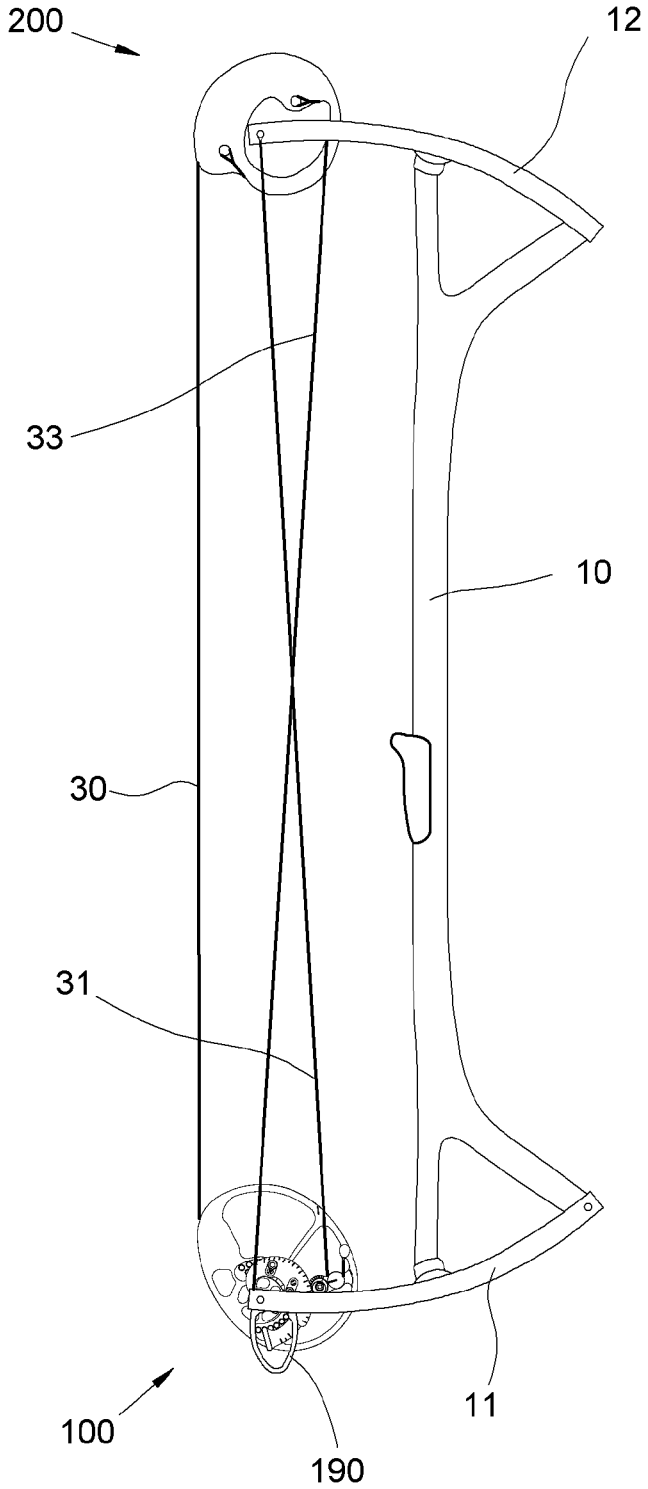
FIG. 4 illustrates schematically an example of a so-called hybrid cam archery bow incorporating an example inventive pulley assembly.

If the bow is a so-called solo cam bow (FIG. 3), then the second pulley assembly 200 comprises an idler wheel and the draw cable 30 passes around the idler wheel and is connected at both ends to the first pulley assembly 100. Upon drawing a solo cam bow, the both ends of the draw cable are let out by the first pulley assembly 100. The power cable 31 is taken up at its first end by the first pulley assembly 100; the second end of the power cable 31 typically is attached, directly or indirectly to the second bow limb 12; in some examples the power cable 31 instead can be let out by the second pulley assembly 200. If the bow is a so-called hybrid cam bow (FIG. 4), then the bow includes an additional coupling cable 33 connected to the first and second pulley members 100 and 200. Upon drawing a hybrid cam bow, the draw cable 30 is let out by both pulley assemblies 100 and 200 and the coupling cable 33 is let out by the first pulley assembly 100 and taken up by the second pulley assembly 200. The power cable 31 is taken up at its first end by the first pulley assembly 100; the second end of the power cable 31 typically is attached, directly or indirectly to the second bow limb 12; in some examples the power cable 31 instead can be let out by the second pulley assembly 200.

The inventive pulley assemblies disclosed herein, or equivalents thereof, can be advantageously employed with any type of compound archery bow, including dual cam, binary cam, solo cam, and hybrid cam bows described above. In a dual or binary cam bow, inventive pulley assemblies can be employed for both pulley assemblies; in a solo or hybrid cam bow, an inventive pulley assembly can be employed for only one pulley assembly.

Figure 5A:
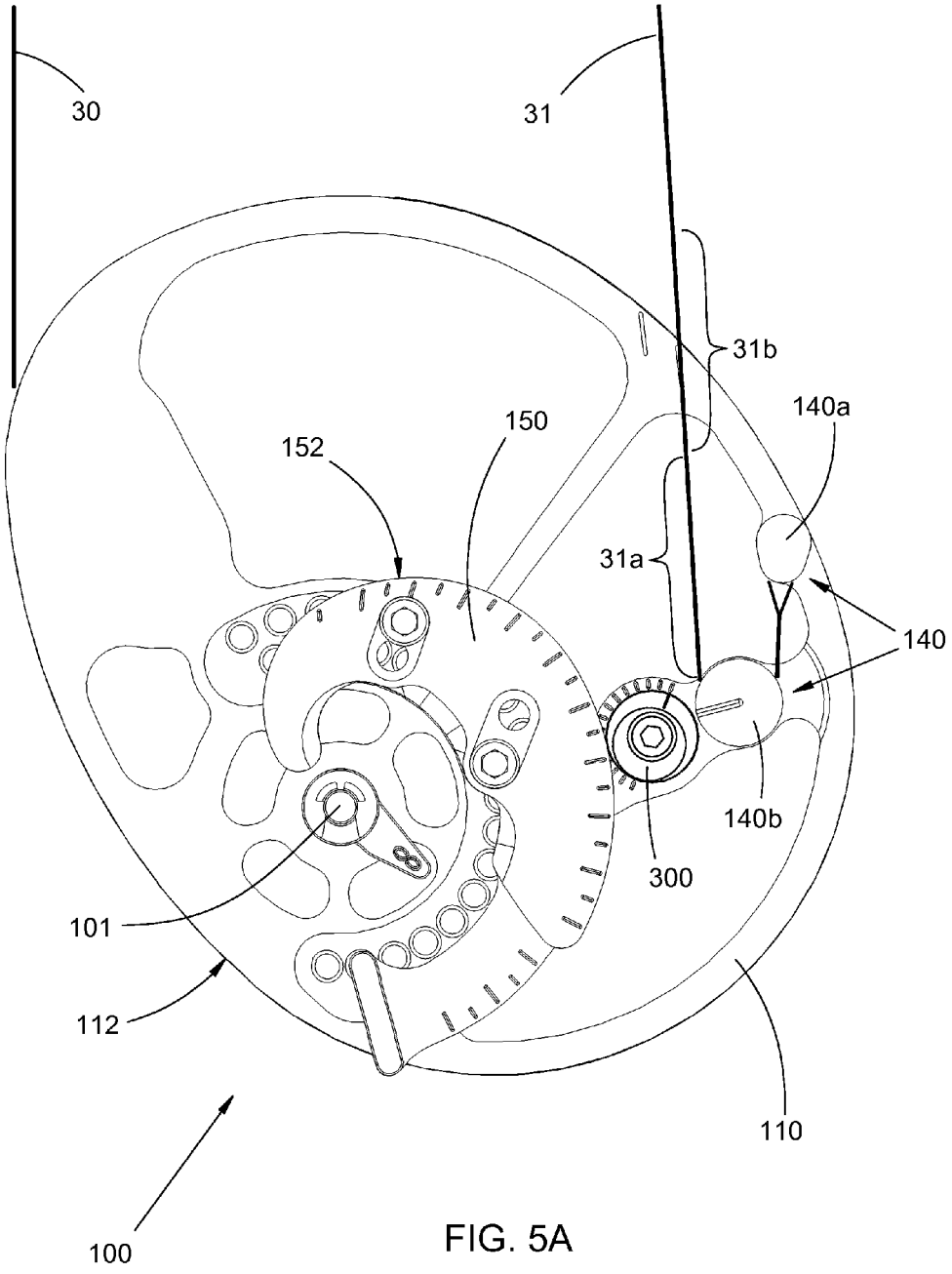
FIGS. 5A-5C are schematic side views of an example inventive pulley assembly in three different example arrangements with the bow at brace.
Figure 5B:
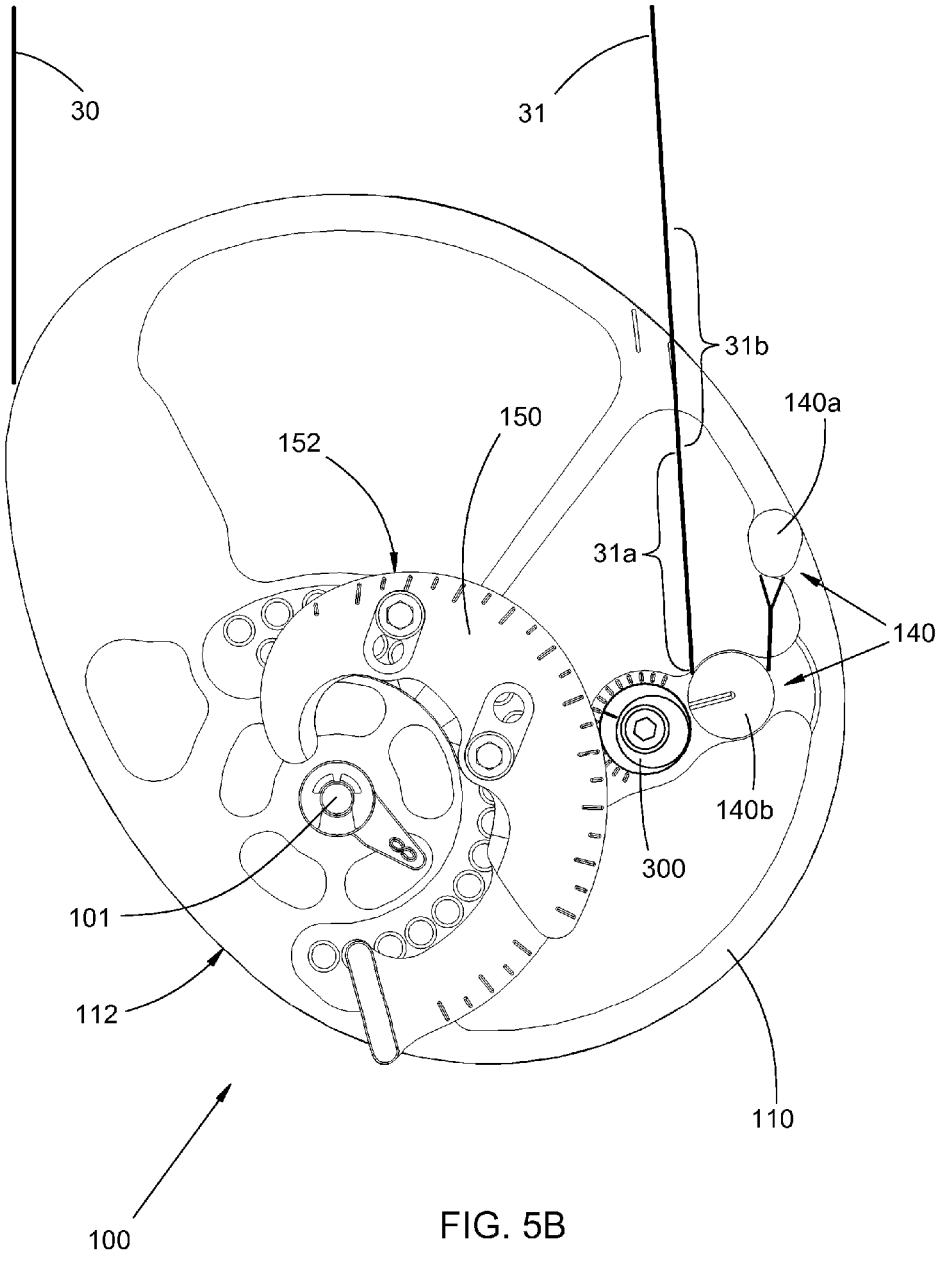
Figure 5C:
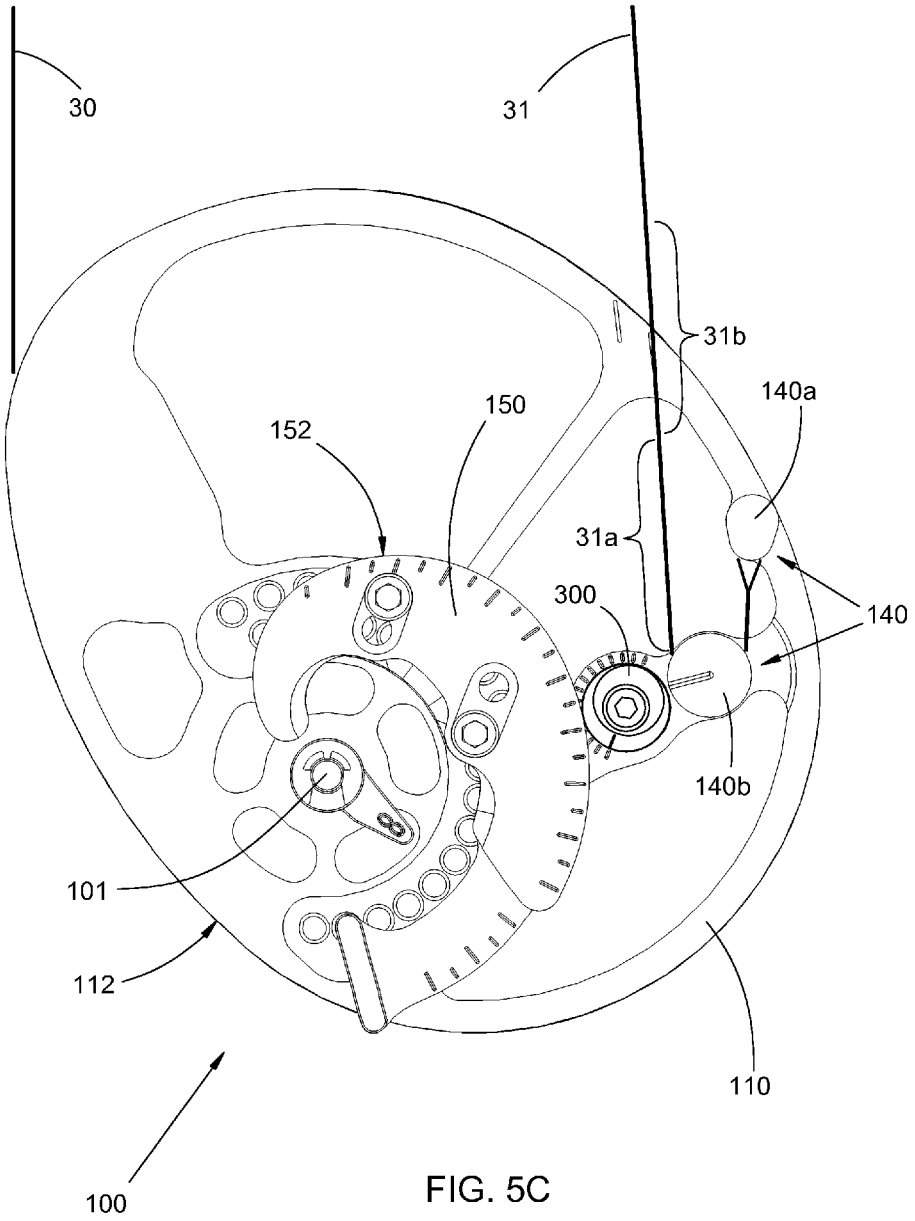
Figure 6A:
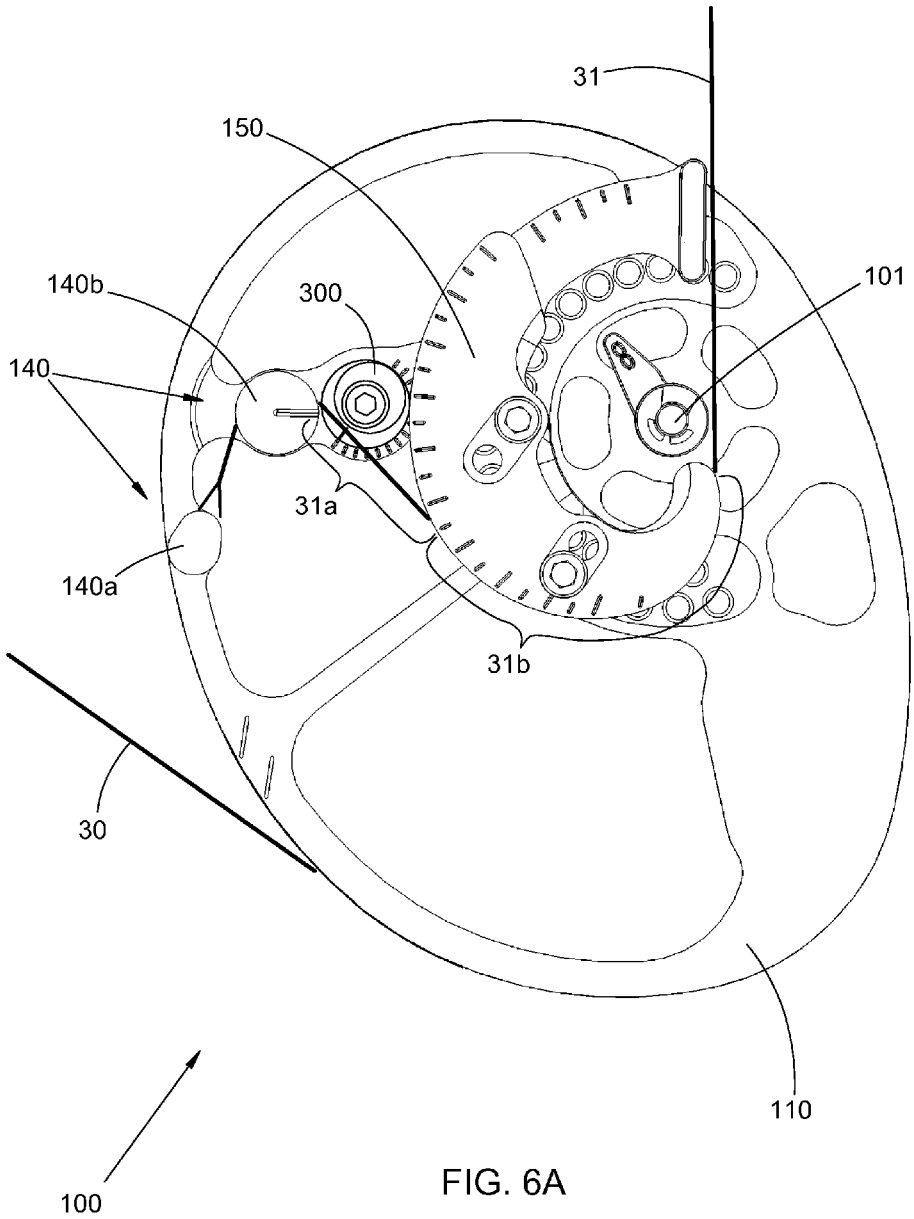
FIGS. 6A-6C are schematic side views of an example inventive pulley assembly in the three different example arrangements of FIGS. 5A-5C, respectively, with the bow at full draw.
Figure 6B:
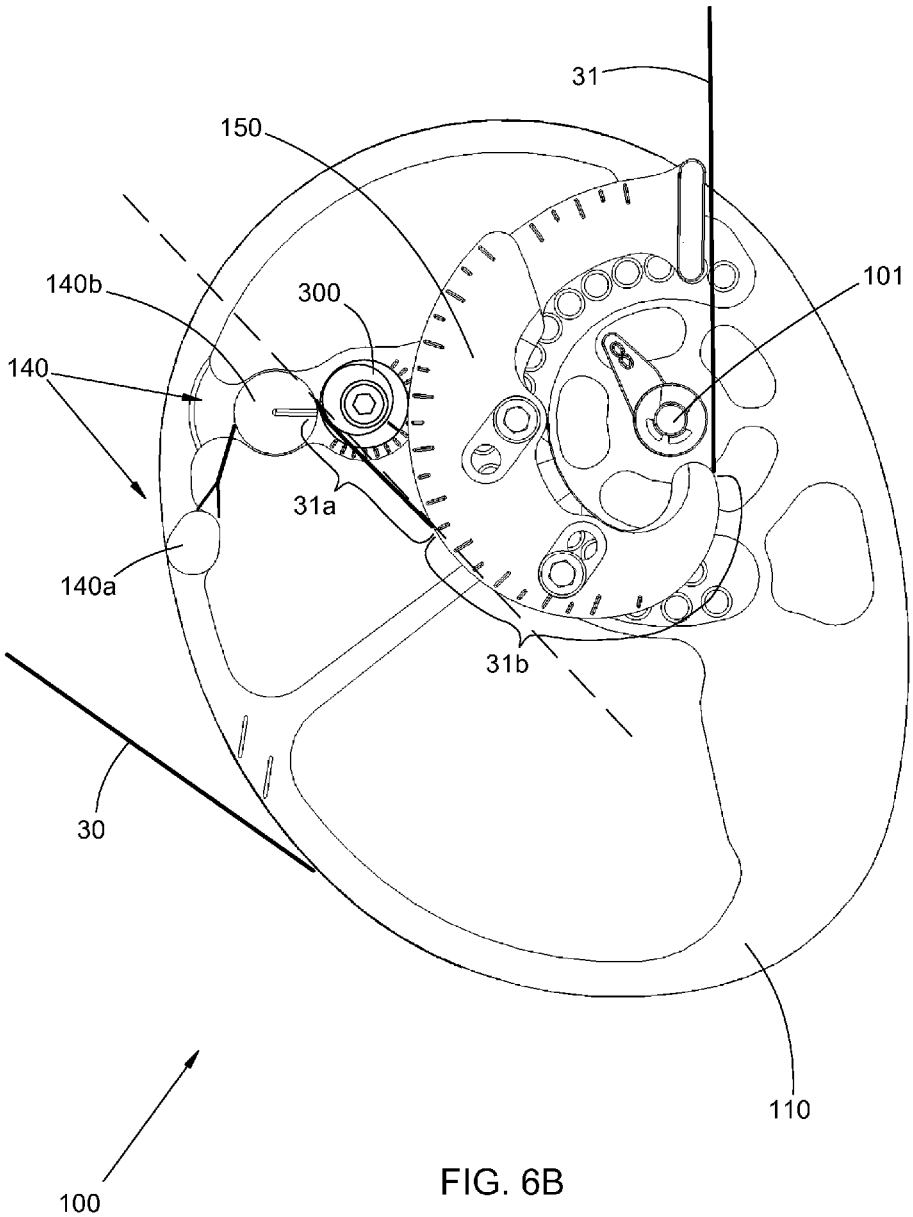
Figure 6C:
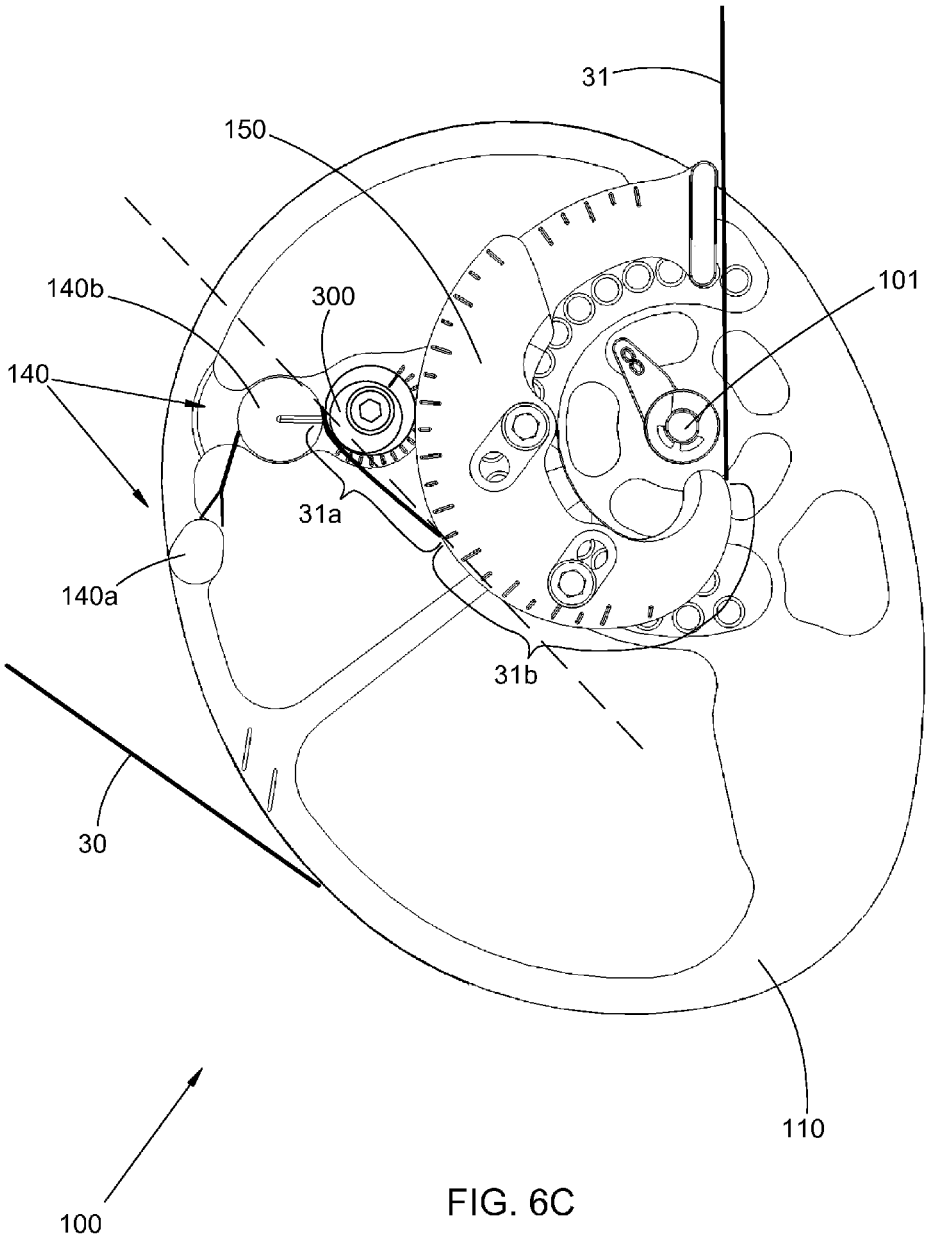

An example of an inventive pulley assembly 100 is shown in FIGS. 5A through 5C (with the bow 10 at brace) and FIGS. 6A through 6C (with the bow 10 at full draw). As noted above, the pulley assembly 200 in a dual or hybrid cam bow can be substantially identical or a substantial mirror image of the pulley assembly 100, and the following description can apply to both pulley assemblies 100 and 200 in such cases. The pulley assembly 100 comprises a draw cable pulley 110, a power cable pulley 150 substantially rigidly attached to the draw cable pulley 110, and a cable deflector 300 substantially rigidly attached to the draw cable pulley 110. Each of those elements can be fabricated in any suitable way from any one or more suitably strong and rigid materials; such elements are commonly fabricated by machining from aluminum; other materials or fabrication methods can be employed. The draw cable pulley 110 defines a first pulley assembly transverse rotation axis 101 and is mounted on the limb 11 in any suitable manner to rotate about the first pulley assembly axis 101. "Transverse" in the context of the present disclosure refers to a direction that is substantially perpendicular to a virtual plane in which the draw cable 30 moves as the bow is drawn; the first pulley assembly axis 101 is substantially perpendicular to that draw cable plane. Suitable mounting arrangements can include one or more of, e.g., an axle passing through the draw cable pulley 110, one or more axle segments integrally formed on the draw cable pulley 110, rotational bearings on the draw cable pulley 110 or on the limb 11, and so on; some examples are disclosed by U.S. Pat. Nos. 8,469,013 and 8,739,769, which are incorporated by reference. The draw cable pulley 110 includes a circumferential draw cable journal or groove 112 arranged around at least a portion of its periphery.

A first end of the draw cable 30 is secured to the draw cable pulley 110 and received in the draw cable journal 112. The draw cable pulley 110 lets out the first end of the draw cable 30 from the draw cable journal 112 when the bow is drawn and the draw cable pulley 110 rotates about the first pulley assembly axis 101. The draw cable pulley 110 can be eccentrically mounted (relative to the first pulley assembly axis 101) or non-circular so as to act as a cam as it lets out the draw cable 30.

The power cable pulley 150 is substantially rigidly attached to the draw cable pulley 110 in any suitable manner. In some examples, the draw cable pulley 110 and the power cable pulley 150 can be integrally formed; in other examples the draw cable pulley 110 and the power cable pulley 150 can be formed as separate parts and then assembled together in any suitable way (directly, or using an intermediate mounting member). In those examples having separate draw cable and power cable pulleys 110/150, the draw cable pulley 110 and the power cable pulley 150 can be attached in only a single fixed arrangement (i.e., relative position and orientation), or one or both of the draw cable pulley 110 and the power cable pulley 150 (or a mounting member, if employed) can be structurally arranged so as to enable substantially rigid attachment of the power cable pulley 150 to the draw cable pulley 100 in any one of multiple power cable pulley arrangements (i.e., relative position and orientation). Each one of those multiple power cable pulley arrangements can result in one or more of: (i) a corresponding draw length of the bow that differs from a draw length resulting from at least one different power cable pulley arrangement; (ii) a corresponding draw weight of the bow that differs from a draw weight resulting from at least one different power cable pulley arrangement; (iii) corresponding stored energy of the drawn bow that differs from stored energy of the drawn bow resulting from at least one different power cable pulley arrangement; or (iv) a corresponding dependence of draw force on draw distance of the bow that differs from a dependence of draw force on draw distance resulting from at least one different power cable pulley arrangement. Examples are disclosed in co-owned U.S. non-provisional application Ser. Nos. 14/318,640 and 14/591,007, which are incorporated by reference as if fully set forth herein.

The power cable pulley 150 has a circumferential power cable journal or groove 152 arranged around at least a portion of its periphery. The power cable pulley 150 is structurally arranged so as to receive the power cable 31 in the circumferential power cable journal 152 and to take up the power cable 31 when the bow is drawn and the draw cable pulley 110 rotates about the first pulley assembly axis 101. The power cable pulley 150 typically is eccentrically mounted (relative to the first pulley assembly axis 101) or non-circular so as to act as a cam as it takes up the power cable 31. Some examples of suitable arrangements are disclosed in U.S. Pat. Nos. 7,305,979; 7,770,568; 8,181,638; 8,469,013; and 8,739,769, and also in co-owned U.S. non-provisional application Ser. Nos. 14/318,640 and 14/591,007. Each of those patents and applications is incorporated by reference as if fully set forth herein.

The draw cable pulley 110 is structurally arranged so as to provide a power cable anchor 140. In the example shown, the power cable anchor 140 includes a primary post 140*a* and a secondary post 140*b*. An end loop of the power cable 31 is placed on the primary post 140*a*, and the power cable 31 spans the distance between the posts 140*a*/140*b* and at least partly wraps around the secondary post 140*b*. In the example shown, the segment of the power cable 31 between the posts 140*a*/140*b* does not move relative to the draw cable pulley 110 as the bow is drawn. In other examples, the power cable 31 might be in contact with the secondary post 140*b* during only a portion of the bow's draw. Other suitable arrangements of the anchor can be employed, e.g., a single post for holding a power cable end loop, or a primary post and multiple secondary posts around which the power cable 31 is at least partly wrapped.

In the example shown, with the bow 10 at brace and also during an earlier phase of drawing the bow 10, the power cable pulley 150 is arranged so that it does not make contact with any portion of the power cable 31. At some intermediate point of the bow's draw, the power cable pulley makes contact with the power cable 31. After that point, during a later phase of drawing the bow, a segment 31*b* of the power cable 31 that is displaced from the power cable anchor 140 is taken up by the circumferential power cable journal 152 of the power cable pulley 150, while a segment 31*a* of the power cable that is immediately adjacent the power cable anchor 140 does not make contact with the power cable pulley 150.

One or both of the cable deflector 300 and the draw cable pulley 110 are structurally arranged so as to enable substantially rigid attachment of the cable deflector 300 to the draw cable pulley 110 in any one of a set of multiple deflector arrangements. In any one of the multiple deflector arrangements, with the bow 10 at brace, the cable deflector 300 causes no lateral deflection, or only negligible lateral deflection, of the power cable 31 (as in FIGS. 5A-5C). In one or more of the multiple deflector arrangements, the cable deflector 300 is positioned and arranged so as to deflect laterally (FIGS. 6B and 6C), during the later phase of drawing the bow 10, the adjacent segment 31*a* of the power cable 31 by a non-negligible amount relative to an undeflected power cable path between the power cable anchor 140 and the power cable pulley 150. That undeflected power cable path is shown in FIG. 6A and indicated by the dashed line in FIGS. 6B and 6C. The non-negligible amount of lateral deflection of each one of the multiple deflector arrangements differs from the amount of lateral deflection of at least one other of the multiple deflector arrangements (FIGS. 6A versus 6B versus 6C).

In some examples, in two or more of the multiple first deflector arrangements (FIGS. 5B/5C and 6B/6C), the cable deflector 300 is positioned and arranged so as to deflect laterally (FIGS. 6B/6C), during the later phase of drawing the bow 10, the adjacent segment 31*a* of the power cable 31 by a non-negligible amount relative to an undeflected first power cable path (FIG. 6A) between the first power cable anchor 140 and the first power cable pulley 150, with the non-negligible amount of lateral deflection varying among the two or more of the multiple first deflector arrangements (FIG. 6B versus FIG. 6C). In some examples, in at least one of the deflector arrangements (FIGS. 5A and 6A), the cable deflector is positioned and arranged so as to cause no lateral deflection, or only negligible lateral deflection, of any segment of the power cable 31 during any phase of drawing the bow 10.

The term "negligible lateral deflection" used above denotes a zero or possibly non-zero amount of lateral deflection of the segment 31*a* of the power cable 31 that might be achieved using the cable deflector 300 but without using a bow press and without partly or fully derigging the bow 10; under those conditions some non-zero amount of deflection of the power cable might be achieved that is functionally irrelevant (e.g., not measurably affecting synchronization of the pulley assemblies) and is therefore negligible. Conversely, a non-negligible amount of deflection by the cable deflector 300 is a non-zero amount of deflection that would produce a noticeable effect on, e.g., synchronization of the pulley assemblies, or would require use of a bow press for installing the cable deflector 300 to achieve such an amount of deflection of the power cable 31 at brace.

One example of a cable deflector 300 is illustrated schematically in FIGS. 7A-7D. In that example, the cable deflector 300 comprises an upper deflector member 301 and a lower deflector member 302. Those can be integrally formed or can be separate parts assembled together. The upper deflector member 301 can take the form of a pin, rod, post, knob, lug, disk, or other suitably shaped member that is substantially rigidly, eccentrically mounted on the lower deflector member 302. In the example shown, the lower deflector member 302 comprises a substantially circular disk that fits into a corresponding circular cavity 113 on the draw cable pulley 110 (FIG. 8A). The cable deflector 300 is substantially rigidly attached to the draw cable pulley 110 with the lower deflector member 302 positioned in the cavity 113 and the upper deflector member 301 protruding from the cavity 113 so as to enable the upper deflector member 301 to deflect the power cable 31. The circular lower deflector member 302, the circular cavity 113, and the eccentric position of the upper deflector member 301 on the circular lower deflector member 302, together result in movement of the upper deflector member 301 relative to the draw cable pulley 110 as the cable deflector 300 is rotated (as in FIGS. 5A through 5C, or FIGS. 6A through 6C). Each different relative rotational position of the lower deflector member 302 within the cavity 113 corresponds to a different deflector arrangement. A screw or other suitable fastener can be employed to fix the cable deflector's position once a rotational position is selected and the cable deflector 300 is rotated to that selected position.

Any other suitable arrangement can be employed for implementing a cable deflector 300, including, e.g.: a translatable or rotatable member deflector member slidable along a flat surface of the draw cable pulley 110 or movable along a slot, groove, spline, ribs, or track or groove on draw cable pulley 110. Any suitable fastener can be employed to fix the cable deflector's position once a position or orientation is selected and the cable deflector 300 is moved to that selected position.

In some examples, the set of multiple deflector arrangements comprises a continuous range of positions or orientations of the cable deflector 300 relative to the draw cable pulley 110. In the example of FIGS. 7A-7D, the circular shape of the lower deflector member 302 can permit a continuous range of relative orientations of the cable deflector 300 in a round cavity of the draw cable pulley 110. In other examples, the set of multiple deflector arrangements comprises a set of discrete positions or orientations of the cable deflector 300 relative to the draw cable pulley 110. In some of those latter examples, the draw cable pulley 110 or the cable deflector 300 can be structurally arranged so as to provide mechanical indexing of each one of the multiple, discrete positions or orientations of the cable deflector 300 relative to the draw cable pulley 110. Such indexing can be implemented in any suitable way, e.g., a series of holes for fasteners, pins, or posts, a series of slots, ribs, splines, or grooves, and so on. In the example shown in FIGS. 8A/8B, the cavity 113 and the lower deflector member 302 each includes corresponding mating sets of radial ribs 114 and 304, respectively, structurally arranged so as to mechanically index a set of multiple, discrete relative rotational positions of the lower deflector member 302 within the cavity 113. A set of continuous positions/orientations can provide finer adjustment of the amount of cable deflection. A set of discrete positions/orientations, particularly with mechanical indexing, can provide more reproducible adjustment, and can increase resistance of the cable deflector to unwanted movement due to lateral forces applied by the deflected cable 31.

A method for adjusting the pulley assembly 100 comprises moving the cable deflector 300 from a first one of the multiple deflector arrangements and substantially rigidly attaching the cable deflector 300 to the draw cable pulley 110 in a second, different one of the multiple deflector arrangements, thereby altering the amount of deflection of the adjacent segment 31*a* of the power cable 31. The differing amounts of deflection of the adjacent segment 31*a* of the power cable 31 result in (i) differing effective lengths of the power cable 31 during the later phase of drawing the bow 10, and (ii) differing relative synchronizations of the pulley assembly 100 with the second pulley assembly 200 mounted on the second bow limb 12. The adjustment (i.e., moving the cable deflector 300 to a new deflector arrangement and attaching it there to the cable pulley 110) can be performed without using a bow press and without derigging the bow (i.e., without removing one or more cables from the bow). The ability to make the adjustment without derigging the bow or using a bow press is highly advantageous.

Adjustments performed on the compound bow 10 by moving the cable deflector 300 offer a number of advantages. Conventionally, to adjust synchronization of the pulley assemblies of a compound bow, a bow press had to be employed and the bow at least partially derigged to adjust the length of one or more cables (usually by adding or subtracting one or more half-twist to/from the cable; adding a half-twist shortens the cable while subtracting a half-twist lengthens the cable). However, those half-twists can only be added or subtracted by derigging the cable in question, adding or subtracting the half-twist, rerigging the bow, and removing it from the press. The iterative process for adjusting cable synchronization was therefore quite tedious and time-consuming. Adding to the frustration, a half-twist (required to maintain proper orientation of anchor loops at the ends of the cable) often proved to be too coarse an increment of length adjustment for properly synchronizing the pulley assemblies.

Using the inventive pulley assembly cable deflector 300 provides several benefits. First, because the power cable 31 is not deflected with the bow 10 at brace (or deflected only negligibly), the cable deflector can be adjusted (i.e., moved among the multiple deflector arrangements and attached to the draw cable pulley 110 at a selected one of those arrangements) without employing the bow press and without derigging the bow partly or fully. In addition, the lateral deflection of the adjacent segment 31*a* of the power cable 31 results in relatively small changes in the effective length of the power cable 31 (more deflection effectively shortening the cable). The adjustments to the effective length of the power cable 31 can be much finer by adjusting the cable deflector 300, compared to employing half-twists for cable length adjustment.

Second, inherent asymmetries of the bow arise from, e.g., lateral deflection (relative to the draw cable plane) of the bow's various cables by a cable guard. Conventionally, because of those asymmetries, typically it has been possible to "line up" (i.e., synchronize) the two pulley assemblies at only one point in their respective rotations during drawing of the bow, by adjusting the actual length of the power cable. The cable deflector 300 enables adjustment of the effective length of the power cable 31 without altering its actual length, and that alteration of effective length only occurs during the later phase of the bow's draw, when the power cable 31 is in contact with the cable deflector 300. In an inventive adjustment method for synchronizing the pulley assemblies 100/200 of a compound bow 10, the actual length of the power cable 31 can be adjusted to "line up" the pulley assemblies 100/200 at brace, and the cable deflector 300 can be adjusted to adjust the effective length of the power cable 31 and "line up" the pulley assemblies 100/200 at full draw.

As noted above, the disclosed inventive pulley assemblies can be employed with any type of compound archery bow, including dual cam, binary cam, solo cam, and hybrid cam bows. In dual or binary cam bows (FIGS. 1 and 2, respectively), the second pulley assembly 200 (rotatably mounted on limb 12) typically is substantially identical to or a substantial mirror image of the first pulley assembly 100 already described. The power cable 32 is taken up by the power cable pulley of the second pulley assembly 200 as the bow is drawn and the second pulley assembly 200 rotates about a corresponding second pulley assembly axis. The cable deflector of the second pulley assembly 200 can be adjusted in the same ways and with the same effect as disclosed above for the first pulley assembly 100. If the bow is a binary cam bow (FIG. 2), the pulley assemblies 100 and 200 each can further comprise a power cable let-out mechanism 180 (e.g., a concentric or eccentric let-out pulley) substantially rigidly coupled to the draw cable pulley 110 or the power cable pulley 150. The power cable let-out mechanism 180 is structurally arranged to receive a corresponding one of the power cables and let out that power cable (during at least a portion of the draw) when the bow is drawn and the pulley assemblies 100 and 200 rotate.

If the bow is a solo cam bow (FIG. 3), the pulley assembly 100 can further comprise a draw cable let-out pulley 190 substantially rigidly coupled to the draw cable pulley 110 or the power cable pulley 150. The draw cable let-out pulley 190 is structurally arranged to receive a second end of the draw cable 30 in a circumferential draw cable journal and let out the second end of the draw cable, with the draw cable passing around an idler wheel (i.e., the second pulley assembly 200 rotatably mounted on the second bow limb 12) when the bow is drawn and the assemblies rotate about the corresponding pulley assembly axes. If the bow is a hybrid cam bow (FIG. 4), the arrangement of the pulley assembly 100 can be similar to that of a solo cam bow, except that the cable received by and let out by the pulley 190 is an additional coupling cable 33 that is taken up by the second pulley assembly 200 as the bow is drawn.

Some examples of arrangements suitable for dual, binary, solo, or hybrid cam bows are disclosed in U.S. Pat. Nos. 7,305,979; 7,770,568; 8,181,638; 8,469,013; and 8,739,769, and also in co-owned U.S. non-provisional application Ser. Nos. 14/318,640 and 14/591,007. Each one of those patents and applications is incorporated by reference as if fully set forth herein.

In addition to the preceding, the following examples fall within the scope of the present disclosure or appended claims:

Example 1

A pulley assembly for a compound archery bow, the pulley assembly comprising a draw cable pulley, a power cable pulley substantially rigidly attached to the draw cable pulley, and an adjustable cable deflector substantially rigidly attached to the draw cable pulley, wherein: (a) the draw cable pulley is structurally arranged so as to (i) define a first pulley assembly transverse rotation axis, (ii) be mounted on a first limb of an archery bow to rotate about the first pulley assembly axis, (iii) let out from a circumferential draw cable journal of the draw cable pulley a draw cable of the archery bow when the bow is drawn and the draw cable pulley rotates about the first pulley assembly axis, and (iv) provide a power cable anchor; (b) the power cable pulley is structurally arranged and positioned on the draw cable pulley so that (i) with the bow at brace and during an earlier phase of drawing the bow, the power cable pulley does not make contact with a power cable of the archery bow that is anchored at the power cable anchor, (ii) during a later phase of drawing the bow, a segment of the power cable that is displaced from the power cable anchor is taken up by a circumferential power cable journal of the power cable pulley, and a segment of the power cable that is immediately adjacent the power cable anchor does not make contact with the power cable pulley; (c) one or both of the cable deflector and the draw cable pulley are structurally arranged so as to enable substantially rigid attachment of the cable deflector to the draw cable pulley in any one of a set of multiple deflector arrangements; (d) in any one of the multiple deflector arrangements, with the bow at brace, the cable deflector causes no lateral deflection, or only negligible lateral deflection, of the power cable; and (e) in one or more of the multiple deflector arrangements, the cable deflector is positioned and arranged so as to deflect laterally, during the later phase of drawing the bow, the adjacent segment of the power cable by a non-negligible amount relative to an undeflected power cable path between the power cable anchor and the power cable pulley, with the non-negligible amount of lateral deflection differing from an amount of lateral deflection of at least one other of the multiple deflector arrangements.

Example 2

The pulley assembly of Example 1 wherein, in two or more of the multiple first deflector arrangements, the cable deflector is positioned and arranged so as to deflect laterally, during the later phase of drawing the bow, the adjacent segment of the power cable by a non-negligible amount relative to an undeflected power cable path between the power cable anchor and the power cable pulley, with the non-negligible amount of lateral deflection varying among the two or more of the multiple deflector arrangements.

Example 3

The pulley assembly of any one of Examples 1 or 2 wherein, in at least one of the deflector arrangements, the cable deflector is positioned and arranged so as to cause no lateral deflection, or only negligible lateral deflection, of any segment of the power cable during any phase of drawing the bow.

Example 4

The pulley assembly of any one of Examples 1 through 3 wherein the set of multiple deflector arrangements comprises a set of discrete positions or orientations of the cable deflector relative to the draw cable pulley.

Example 5

The pulley assembly of Example 4 wherein the draw cable pulley or the cable deflector is structurally arranged so as to provide mechanical indexing of each one of the multiple, discrete positions or orientations of the cable deflector relative to the draw cable pulley.

Example 6

The pulley assembly of any one of Examples 1 through 3 wherein the set of multiple deflector arrangements comprises a continuous range of positions or orientations of the cable deflector relative to the draw cable pulley.

Example 7

The pulley assembly of any one of Examples 1 through 6 wherein: (f) the cable deflector comprises an upper deflector member substantially rigidly, eccentrically mounted on a substantially circular lower deflector member; (g) the draw cable pulley includes a substantially circular cavity sized so as to accommodate the lower deflector member of the cable deflector positioned within the cavity; (h) the cable deflector is substantially rigidly attached to the draw cable pulley with the lower deflector member positioned in the cavity and the upper deflector member protruding from the cavity so as to enable the upper deflector member to deflect the power cable; and (i) each different relative rotational position of the lower deflector member within the cavity corresponds to a different deflector arrangement.

Example 8

The pulley assembly of Example 7 wherein the cavity and the lower deflector member include respective mating sets of radial ribs structurally arranged so as to mechanically index a set of multiple, discrete relative rotational positions of the lower deflector member within the cavity.

Example 9

The pulley assembly of any one of Examples 1 through 8 further comprising a second pulley assembly, wherein: (f) the second pulley assembly comprises a second draw cable pulley, a second power cable pulley substantially rigidly attached to the second draw cable pulley, and a second adjustable cable deflector substantially rigidly attached to the second draw cable pulley; (g) the second draw cable pulley is structurally arranged so as to (i) define a second pulley assembly transverse rotation axis, (ii) be mounted on a second limb of the bow to rotate about the second pulley assembly axis, (iii) let out a draw cable of the archery bow from a circumferential draw cable journal of the second draw cable pulley when the bow is drawn and the second draw cable pulley rotates about the second pulley assembly axis, and (iv) provide a second power cable anchor; (h) the second power cable pulley is structurally arranged and positioned on the second draw cable pulley so that (i) with the bow at brace and during an earlier phase of drawing the bow, the second power cable pulley does not make contact with a second power cable of the archery bow that is anchored at the second power cable anchor, (ii) during a later phase of drawing the bow, a segment of the second power cable that is displaced from the second power cable anchor is taken up by a circumferential power cable journal of the second power cable pulley, and a segment of the second power cable that is immediately adjacent the second power cable anchor does not make contact with the second power cable pulley; (i) one or both of the second cable deflector and the second draw cable pulley are structurally arranged so as to enable substantially rigid attachment of the second cable deflector to the second draw cable pulley in any one of a set of multiple second deflector arrangements; (j) in any one of the multiple second deflector arrangements, with the bow at brace, the second cable deflector causes no lateral deflection, or only negligible lateral deflection, of the second power cable; and (k) in one or more of the multiple second deflector arrangements, the second cable deflector is positioned and arranged so as to deflect laterally, during the later phase of drawing the bow, the adjacent segment of the second power cable by a non-negligible amount relative to an undeflected second power cable path between the second power cable anchor and the second power cable pulley, with the non-negligible amount of lateral deflection differing from an amount of lateral deflection of at least one other of the multiple second deflector arrangements.

Example 10

The pulley assembly of any one of Examples 1 through 9 wherein the pulley assembly further comprises a cable let-out pulley substantially rigidly attached to the draw cable pulley or the power cable pulley, wherein the cable let-out pulley is structurally arranged so as to let out from a circumferential journal of the let-out pulley an additional cable of the archery bow when the bow is drawn and the draw cable pulley rotates about the first pulley assembly axis.

Example 11

The pulley assembly of any one of Examples 1 through 10 wherein one or both of the draw cable pulley and the power cable pulley are structurally arranged so as to enable substantially rigid attachment of the power cable pulley to the draw cable pulley in any one of multiple power cable pulley arrangements.

Example 12

The pulley assembly of Example 11 wherein each one of the multiple power cable pulley arrangements results in one or more of: (i) a corresponding draw length of the bow that differs from a draw length resulting from at least one different power cable pulley arrangement; (ii) a corresponding draw weight of the bow that differs from a draw weight resulting from at least one different power cable pulley arrangement; (iii) corresponding stored energy of the drawn bow that differs from stored energy of the drawn bow resulting from at least one different power cable pulley arrangement; or (iv) a corresponding dependence of draw force on draw distance of the bow that differs from a dependence of draw force on draw distance resulting from at least one different power cable pulley arrangement.

Example 13

A method for adjusting the pulley assembly of Example 12, the method comprising moving the power cable pulley from a first one of the multiple power cable pulley arrangements and substantially rigidly attaching the power cable pulley to the draw cable pulley in a second, different one of the multiple power cable pulley arrangements, thereby altering one or more of the draw weight, the draw length, the stored energy of the drawn bow, or the dependence of draw force on draw distance.

Example 14

A method for adjusting the pulley assembly of any one of Examples 1 through 12, the method comprising moving the cable deflector from a first one of the multiple deflector arrangements and substantially rigidly attaching the cable deflector to the draw cable pulley in a second, different one of the multiple deflector arrangements, thereby altering the amount of deflection of the adjacent segment of the power cable.

Example 15

The method of Example 14 wherein differing amounts of deflection of the adjacent segment of the power cable result in (i) differing effective lengths of the power cable during the later phase of drawing the bow, and (ii) differing relative synchronizations of the pulley assembly with a second pulley assembly mounted on a second limb of the compound archery bow.

Example 16

The method of any one of Examples 14 or 15 wherein the cable deflector is moved and attached without using a bow press and without derigging the bow.

Example 17

A compound archery bow, comprising a central riser, first and second bow limbs secured to opposing ends of the riser, first and second pulley assemblies rotatably mounted on the first and second bow limbs, respectively, a draw cable, and a power cable, wherein: (a) the first pulley assembly comprises a first draw cable pulley, a first power cable pulley substantially rigidly attached to the first draw cable pulley, and a first adjustable cable deflector substantially rigidly attached to the first draw cable pulley; (b) the first draw cable pulley is structurally arranged so as to (i) define a first pulley assembly transverse rotation axis, (ii) be mounted on the first bow limb to rotate about the first pulley assembly axis, (iii) let out from a circumferential draw cable journal of the first draw cable pulley the draw cable when the bow is drawn and the draw cable pulley rotates about the first pulley assembly axis, and (iv) provide a first power cable anchor; (c) the first power cable pulley is structurally arranged and positioned on the first draw cable pulley so that (i) with the bow at brace and during an earlier phase of drawing the bow, the first power cable pulley does not make contact with the first power cable that is anchored at the first power cable anchor, (ii) during a later phase of drawing the bow, a segment of the first power cable that is displaced from the first power cable anchor is taken up by a circumferential power cable journal of the first power cable pulley, and a segment of the first power cable that is immediately adjacent the first power cable anchor does not make contact with the first power cable pulley; (d) one or both of the first cable deflector and the first draw cable pulley are structurally arranged so as to enable substantially rigid attachment of the first cable deflector to the first draw cable pulley in any one of a set of multiple first deflector arrangements; (e) in any one of the multiple deflector arrangements, with the bow at brace, the cable deflector causes no lateral deflection, or only negligible lateral deflection, of the power cable; and (f) in one or more of the multiple deflector arrangements, the cable deflector is positioned and arranged so as to deflect laterally, during the later phase of drawing the bow, the adjacent segment of the power cable by a non-negligible amount relative to an undeflected power cable path between the power cable anchor and the power cable pulley, with the non-negligible amount of lateral deflection differing from an amount of lateral deflection of at least one other of the multiple deflector arrangements.

Example 18

The bow of Example 17 wherein, in two or more of the multiple first deflector arrangements, the first cable deflector is positioned and arranged so as to deflect laterally, during the later phase of drawing the bow, the adjacent segment of the first power cable by a non-negligible amount relative to an undeflected first power cable path between the first power cable anchor and the first power cable pulley, with the non-negligible amount of lateral deflection varying among the two or more of the multiple first deflector arrangements.

Example 19

The bow of any one of Examples 17 or 18 wherein, in at least one of the first deflector arrangements, the first cable deflector is positioned and arranged so as to cause no lateral deflection, or only negligible lateral deflection, of any segment of the first power cable during any phase of drawing the bow.

Example 20

The bow of any one of Examples 17 through 19 wherein the set of multiple first deflector arrangements comprises a set of discrete positions or orientations of the first cable deflector relative to the first draw cable pulley.

Example 21

The bow of Example 20 wherein the first draw cable pulley or the first cable deflector is structurally arranged so as to provide mechanical indexing of each one of the multiple, discrete positions or orientations of the first cable deflector relative to the first draw cable pulley.

Example 22

The bow of any one of Examples 17 through 19 wherein the set of multiple first deflector arrangements comprises a continuous range of positions or orientations of the first cable deflector relative to the first draw cable pulley.

Example 23

The bow of any one of Examples 17 through 22 wherein: (g) the first cable deflector comprises an upper deflector member substantially rigidly, eccentrically mounted on a substantially circular lower deflector member; (h) the first draw cable pulley includes a substantially circular cavity sized so as to accommodate the lower deflector member of the first cable deflector positioned within the cavity; (i) the first cable deflector is substantially rigidly attached to the first draw cable pulley with the lower deflector member positioned in the cavity and the upper deflector member protruding from the cavity so as to enable the upper deflector member to deflect the first power cable; and (j) each different relative rotational position of the lower deflector member within the cavity corresponds to a different first deflector arrangement.

Example 24

The bow of Example 23 wherein the cavity and the lower deflector member include respective mating sets of radial ribs structurally arranged so as to mechanically index a set of multiple, discrete relative rotational positions of the lower deflector member within the cavity.

Example 25

The bow of any one of Examples 17 through 24 further comprising a second power cable, wherein: (g) the second pulley assembly comprises a second draw cable pulley, a second power cable pulley substantially rigidly attached to the second draw cable pulley, and a second adjustable cable deflector substantially rigidly attached to the second draw cable pulley; (h) the second draw cable pulley is structurally arranged so as to (i) define a second pulley assembly transverse rotation axis, (ii) be mounted on the second bow limb to rotate about the second pulley assembly axis, (iii) let out the draw cable from a circumferential draw cable journal of the second draw cable pulley when the bow is drawn and the second draw cable pulley rotates about the second pulley assembly axis, and (iv) provide a second power cable anchor; (i) the second power cable pulley is structurally arranged and positioned on the second draw cable pulley so that (i) with the bow at brace and during an earlier phase of drawing the bow, the second power cable pulley does not make contact with the second power cable that is anchored at the second power cable anchor, (ii) during a later phase of drawing the bow, a segment of the second power cable that is displaced from the second power cable anchor is taken up by a circumferential power cable journal of the second power cable pulley, and a segment of the second power cable that is immediately adjacent the second power cable anchor does not make contact with the second power cable pulley; (j) one or both of the second cable deflector and the second draw cable pulley are structurally arranged so as to enable substantially rigid attachment of the second cable deflector to the second draw cable pulley in any one of a set of multiple second deflector arrangements; (k) in any one of the multiple second deflector arrangements, with the bow at brace, the second cable deflector causes no lateral deflection, or only negligible lateral deflection, of the second power cable; and (l) in one or more of the multiple second deflector arrangements, the second cable deflector is positioned and arranged so as to deflect laterally, during the later phase of drawing the bow, the adjacent segment of the second power cable by a non-negligible amount relative to an undeflected second power cable path between the second power cable anchor and the second power cable pulley, with the non-negligible amount of lateral deflection differing from an amount of lateral deflection of at least one other of the multiple second deflector arrangements.

Example 26

The bow of Example 25 wherein: (m) the first pulley assembly further comprises a first power cable let-out pulley substantially rigidly attached to the first draw cable pulley or the first power cable pulley; (n) the first power cable let-out pulley is structurally arranged so as to let out from a circumferential power cable journal of the first power cable let-out pulley the second power cable when the bow is drawn and the first draw cable pulley rotates about the first pulley assembly axis; (o) the second pulley assembly further comprises a second power cable let-out pulley substantially rigidly attached to the second draw cable pulley or the second power cable pulley; and (p) the second power cable let-out pulley is structurally arranged so as to let out from a circumferential power cable journal of the second power cable let-out pulley the first power cable when the bow is drawn and the second draw cable pulley rotates about the second pulley assembly axis.

Example 27

The bow of any one of Examples 17 through 24 wherein the second pulley assembly includes a power cable let-out pulley that is structurally arranged so as to let out from a circumferential power cable journal of the power cable let-out pulley the power cable when the bow is drawn and the draw cable pulley rotates about the first pulley assembly axis.

Example 28

The bow of any one of Examples 17 through 24 wherein: (g) the first pulley assembly further comprises a draw cable let-out pulley substantially rigidly attached to the first draw cable pulley or the first power cable pulley; (h) the second pulley assembly comprises an idler wheel; and (i) the draw cable let-out pulley is structurally arranged so as to let out from a circumferential draw cable journal of the draw cable let-out pulley the second end of the draw cable, with the draw cable passing around the idler wheel, when the bow is drawn and the draw cable pulley rotates about the first pulley assembly axis.

Example 29

The bow of any one of Examples 17 through 24 further comprising a coupling cable, wherein: (g) the first pulley assembly further comprises a coupling cable let-out pulley substantially rigidly attached to the first draw cable pulley or the first power cable pulley; (h) the second pulley assembly comprises a second draw cable pulley and a coupling cable take-up pulley; (i) the second draw cable pulley is structurally arranged so as to let out from a circumferential draw cable journal of the second draw cable pulley the draw cable when the bow is drawn and the second pulley assembly rotates about the second pulley assembly axis; (j) the coupling cable take-up pulley is structurally arranged so as to take up into a circumferential coupling cable journal of the coupling cable take-up pulley a first end of the coupling cable when the bow is drawn and the second pulley assembly rotates about the second pulley assembly axis; and (k) the coupling cable let-out pulley is structurally arranged so as to let out from a circumferential coupling cable journal of the coupling cable let-out pulley a second end of the coupling cable when the bow is drawn and the first draw cable pulley rotates about the first pulley assembly axis.

Example 30

The bow of any one of Examples 17 through 29 wherein one or both of the first draw cable pulley and the first power cable pulley are structurally arranged so as to enable substantially rigid attachment of the first power cable pulley to the first draw cable pulley in any one of multiple first power cable pulley arrangements.

Example 31

The bow of Example 30 wherein each one of the multiple first power cable pulley arrangements results in one or more of: (i) a corresponding draw length of the bow that differs from a draw length resulting from at least one different first power cable pulley arrangement; (ii) a corresponding draw weight of the bow that differs from a draw weight resulting from at least one different first power cable pulley arrangement; (iii) corresponding stored energy of the drawn bow that differs from stored energy of the drawn bow resulting from at least one different first power cable pulley arrangement; or (iv) a corresponding dependence of draw force on draw distance of the bow that differs from a dependence of draw force on draw distance resulting from at least one different first power cable pulley arrangement.

Example 32

A method for adjusting the bow of Example 31, the method comprising moving the first power cable pulley from a first one of the multiple first power cable pulley arrangements and substantially rigidly attaching the first power cable pulley to the first draw cable pulley in a second, different one of the multiple first power cable pulley arrangements, thereby altering one or more of the draw weight, the draw length, the stored energy of the drawn bow, or the dependence of draw force on draw distance.

Example 33

A method for adjusting the bow of Examples 17 through 31, the method comprising moving the first cable deflector from a first one of the multiple first deflector arrangements and substantially rigidly attaching the first cable deflector to the first draw cable pulley in a second, different one of the multiple first deflector arrangements, thereby altering the amount of deflection of the adjacent segment of the first power cable.

Example 34

The method of Example 33 wherein differing amounts of deflection of the adjacent segment of the power cable result in (i) differing effective lengths of the power cable during the later phase of drawing the bow, and (ii) differing relative synchronizations of the pulley assembly with a second pulley assembly mounted on a second limb of the compound archery bow.

Example 35

The method of any one of Examples 33 or 34 wherein the cable deflector is moved and attached without using a bow press and without derigging the bow.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A pulley assembly for a compound archery bow, the pulley assembly comprising a draw cable pulley, a power cable pulley substantially rigidly attached to the draw cable pulley, and an adjustable cable deflector substantially rigidly attached to the draw cable pulley, wherein:

(a) the draw cable pulley is structurally arranged so as to (i) define a first pulley assembly transverse rotation axis, (ii) be mounted on a first limb of an archery bow to rotate about the first pulley assembly axis, (iii) let out from a circumferential draw cable journal of the draw cable pulley a draw cable of the archery bow when the bow is drawn and the draw cable pulley rotates about the first pulley assembly axis, and (iv) provide a power cable anchor;

(b) the power cable pulley is structurally arranged and positioned on the draw cable pulley so that (i) with the bow at brace and during an earlier phase of drawing the bow, the power cable pulley does not make contact with a power cable of the archery bow that is anchored at the power cable anchor, (ii) during a later phase of drawing the bow, a segment of the power cable that is displaced from the power cable anchor is taken up by a circumferential power cable journal of the power cable pulley, and a segment of the power cable that is immediately adjacent the power cable anchor does not make contact with the power cable pulley;

(c) one or both of the cable deflector and the draw cable pulley are structurally arranged so as to enable substantially rigid attachment of the cable deflector to the draw cable pulley in any one of a set of multiple deflector arrangements;

(d) in any one of the multiple deflector arrangements, with the bow at brace, the cable deflector causes no lateral deflection, or only negligible lateral deflection, of the power cable; and (e) in one or more of the multiple deflector arrangements, the cable deflector is positioned and arranged so as to deflect laterally, during the later phase of drawing the bow, the adjacent segment of the power cable by a non-negligible amount relative to an undeflected power cable path between the power cable anchor and the power cable pulley, with the non-negligible amount of lateral deflection differing from an amount of lateral deflection of at least one other of the multiple deflector arrangements.

2. A method for adjusting the pulley assembly of claim 1, the method comprising moving the cable deflector from a first one of the multiple deflector arrangements and substantially rigidly attaching the cable deflector to the draw cable pulley in a second, different one of the multiple deflector arrangements, thereby altering the amount of deflection of the adjacent segment of the power cable.

3. The method of claim 2 wherein differing amounts of deflection of the adjacent segment of the power cable result in (i) differing effective lengths of the power cable during the later phase of drawing the bow, and (ii) differing relative synchronizations of the pulley assembly with a second pulley assembly mounted on a second limb of the compound archery bow.

4. The method of claim 2 wherein the cable deflector is moved and attached without using a bow press and without derigging the bow.

5. The pulley assembly of claim 1 wherein, in two or more of the multiple first deflector arrangements, the cable deflector is positioned and arranged so as to deflect laterally, during the later phase of drawing the bow, the adjacent segment of the power cable by a non-negligible amount relative to an undeflected power cable path between the power cable anchor and the power cable pulley, with the non-negligible amount of lateral deflection varying among the two or more of the multiple deflector arrangements.

6. The pulley assembly of claim 1 wherein, in at least one of the deflector arrangements, the cable deflector is positioned and arranged so as to cause no lateral deflection, or only negligible lateral deflection, of any segment of the power cable during any phase of drawing the bow.

7. The pulley assembly of claim 1 wherein the set of multiple deflector arrangements comprises a set of discrete positions or orientations of the cable deflector relative to the draw cable pulley.

8. The pulley assembly of claim 7 wherein the draw cable pulley or the cable deflector is structurally arranged so as to provide mechanical indexing of each one of the multiple, discrete positions or orientations of the cable deflector relative to the draw cable pulley.

9. The pulley assembly of claim 1 wherein the set of multiple deflector arrangements comprises a continuous range of positions or orientations of the cable deflector relative to the draw cable pulley.

10. The pulley assembly of claim 1 wherein:

(f) the cable deflector comprises an upper deflector member substantially rigidly, eccentrically mounted on a substantially circular lower deflector member;

(g) the draw cable pulley includes a substantially circular cavity sized so as to accommodate the lower deflector member of the cable deflector positioned within the cavity;

(h) the cable deflector is substantially rigidly attached to the draw cable pulley with the lower deflector member positioned in the cavity and the upper deflector member protruding from the cavity so as to enable the upper deflector member to deflect the power cable; and (i) each different relative rotational position of the lower deflector member within the cavity corresponds to a different deflector arrangement.

11. The pulley assembly of claim 10 wherein the cavity and the lower deflector member include respective mating sets of radial ribs structurally arranged so as to mechanically index a set of multiple, discrete relative rotational positions of the lower deflector member within the cavity.

12. The pulley assembly of claim 1 wherein one or both of the draw cable pulley and the power cable pulley are structurally arranged so as to enable substantially rigid attachment of the power cable pulley to the draw cable pulley in any one of multiple power cable pulley arrangements.

13. The pulley assembly of claim 12 wherein each one of the multiple power cable pulley arrangements results in one or more of: (i) a corresponding draw length of the bow that differs from a draw length resulting from at least one different power cable pulley arrangement; (ii) a corresponding draw weight of the bow that differs from a draw weight resulting from at least one different power cable pulley arrangement; (iii) corresponding stored energy of the drawn bow that differs from stored energy of the drawn bow resulting from at least one different power cable pulley arrangement; or (iv) a corresponding dependence of draw force on draw distance of the bow that differs from a dependence of draw force on draw distance resulting from at least one different power cable pulley arrangement.

14. A method for adjusting the pulley assembly of claim 13, the method comprising moving the power cable pulley from a first one of the multiple power cable pulley arrangements and substantially rigidly attaching the power cable pulley to the draw cable pulley in a second, different one of the multiple power cable pulley arrangements, thereby altering one or more of the draw weight, the draw length, the stored energy of the drawn bow, or the dependence of draw force on draw distance.

15. The pulley assembly of claim 1 further comprising a second pulley assembly, wherein:

(f) the second pulley assembly comprises a second draw cable pulley, a second power cable pulley substantially rigidly attached to the second draw cable pulley, and a second adjustable cable deflector substantially rigidly attached to the second draw cable pulley;

(g) the second draw cable pulley is structurally arranged so as to (i) define a second pulley assembly transverse rotation axis, (ii) be mounted on a second limb of the bow to rotate about the second pulley assembly axis, (iii) let out a draw cable of the archery bow from a circumferential draw cable journal of the second draw cable pulley when the bow is drawn and the second draw cable pulley rotates about the second pulley assembly axis, and (iv) provide a second power cable anchor;

(h) the second power cable pulley is structurally arranged and positioned on the second draw cable pulley so that (i) with the bow at brace and during an earlier phase of drawing the bow, the second power cable pulley does not make contact with a second power cable of the archery bow that is anchored at the second power cable anchor, (ii) during a later phase of drawing the bow, a segment of the second power cable that is displaced from the second power cable anchor is taken up by a circumferential power cable journal of the second power cable pulley, and a segment of the second power cable that is immediately adjacent the second power cable anchor does not make contact with the second power cable pulley;

(i) one or both of the second cable deflector and the second draw cable pulley are structurally arranged so as to enable substantially rigid attachment of the second cable deflector to the second draw cable pulley in any one of a set of multiple second deflector arrangements;

(j) in any one of the multiple second deflector arrangements, with the bow at brace, the second cable deflector causes no lateral deflection, or only negligible lateral deflection, of the second power cable; and (k) in one or more of the multiple second deflector arrangements, the second cable deflector is positioned and arranged so as to deflect laterally, during the later phase of drawing the bow, the adjacent segment of the second power cable by a non-negligible amount relative to an undeflected second power cable path between the second power cable anchor and the second power cable pulley, with the non-negligible amount of lateral deflection differing from an amount of lateral deflection of at least one other of the multiple second deflector arrangements.

16. The pulley assembly of claim 1 wherein the pulley assembly further comprises a cable let-out pulley substantially rigidly attached to the draw cable pulley or the power cable pulley, wherein the cable let-out pulley is structurally arranged so as to let out from a circumferential journal of the let-out pulley an additional cable of the archery bow when the bow is drawn and the draw cable pulley rotates about the first pulley assembly axis.

17. A compound archery bow, comprising a central riser, first and second bow limbs secured to opposing ends of the riser, first and second pulley assemblies rotatably mounted on the first and second bow limbs, respectively, a draw cable, and a power cable, wherein:

(a) the first pulley assembly comprises a first draw cable pulley, a first power cable pulley substantially rigidly attached to the first draw cable pulley, and a first adjustable cable deflector substantially rigidly attached to the first draw cable pulley;

(b) the first draw cable pulley is structurally arranged so as to (i) define a first pulley assembly transverse rotation axis, (ii) be mounted on the first bow limb to rotate about the first pulley assembly axis, (iii) let out from a circumferential draw cable journal of the first draw cable pulley the draw cable when the bow is drawn and the draw cable pulley rotates about the first pulley assembly axis, and (iv) provide a first power cable anchor;

(c) the first power cable pulley is structurally arranged and positioned on the first draw cable pulley so that (i) with the bow at brace and during an earlier phase of drawing the bow, the first power cable pulley does not make contact with the first power cable that is anchored at the first power cable anchor, (ii) during a later phase of drawing the bow, a segment of the first power cable that is displaced from the first power cable anchor is taken up by a circumferential power cable journal of the first power cable pulley, and a segment of the first power cable that is immediately adjacent the first power cable anchor does not make contact with the first power cable pulley;

(d) one or both of the first cable deflector and the first draw cable pulley are structurally arranged so as to enable substantially rigid attachment of the first cable deflector to the first draw cable pulley in any one of a set of multiple first deflector arrangements;

(e) in any one of the multiple deflector arrangements, with the bow at brace, the cable deflector causes no lateral deflection, or only negligible lateral deflection, of the power cable; and (f) in one or more of the multiple deflector arrangements, the cable deflector is positioned and arranged so as to deflect laterally, during the later phase of drawing the bow, the adjacent segment of the power cable by a non-negligible amount relative to an undeflected power cable path between the power cable anchor and the power cable pulley, with the non-negligible amount of lateral deflection differing from an amount of lateral deflection of at least one other of the multiple deflector arrangements.

18. A method for adjusting the bow of claim 17, the method comprising moving the first cable deflector from a first one of the multiple first deflector arrangements and substantially rigidly attaching the first cable deflector to the first draw cable pulley in a second, different one of the multiple first deflector arrangements, thereby altering the amount of deflection of the adjacent segment of the first power cable.

19. The method of claim 18 wherein differing amounts of deflection of the adjacent segment of the power cable result in (i) differing effective lengths of the power cable during the later phase of drawing the bow, and (ii) differing relative synchronizations of the pulley assembly with a second pulley assembly mounted on a second limb of the compound archery bow.

20. The method of claim 18 wherein the cable deflector is moved and attached without using a bow press and without derigging the bow.

21. The bow of claim 17 wherein, in two or more of the multiple first deflector arrangements, the first cable deflector is positioned and arranged so as to deflect laterally, during the later phase of drawing the bow, the adjacent segment of the first power cable by a non-negligible amount relative to an undeflected first power cable path between the first power cable anchor and the first power cable pulley, with the non-negligible amount of lateral deflection varying among the two or more of the multiple first deflector arrangements.

22. The bow of claim 17 wherein, in at least one of the first deflector arrangements, the first cable deflector is positioned and arranged so as to cause no lateral deflection, or only negligible lateral deflection, of any segment of the first power cable during any phase of drawing the bow.

23. The bow of claim 17 wherein the set of multiple first deflector arrangements comprises a set of discrete positions or orientations of the first cable deflector relative to the first draw cable pulley.

24. The bow of claim 23 wherein the first draw cable pulley or the first cable deflector is structurally arranged so as to provide mechanical indexing of each one of the multiple, discrete positions or orientations of the first cable deflector relative to the first draw cable pulley.

25. The bow of claim 17 wherein the set of multiple first deflector arrangements comprises a continuous range of positions or orientations of the first cable deflector relative to the first draw cable pulley.

26. The bow of claim 17 wherein:

(g) the first cable deflector comprises an upper deflector member substantially rigidly, eccentrically mounted on a substantially circular lower deflector member;

(h) the first draw cable pulley includes a substantially circular cavity sized so as to accommodate the lower deflector member of the first cable deflector positioned within the cavity;

(i) the first cable deflector is substantially rigidly attached to the first draw cable pulley with the lower deflector member positioned in the cavity and the upper deflector member protruding from the cavity so as to enable the upper deflector member to deflect the first power cable; and (j) each different relative rotational position of the lower deflector member within the cavity corresponds to a different first deflector arrangement.

27. The bow of claim 26 wherein the cavity and the lower deflector member include respective mating sets of radial ribs structurally arranged so as to mechanically index a set of multiple, discrete relative rotational positions of the lower deflector member within the cavity.

28. The bow of claim 17 wherein one or both of the first draw cable pulley and the first power cable pulley are structurally arranged so as to enable substantially rigid attachment of the first power cable pulley to the first draw cable pulley in any one of multiple first power cable pulley arrangements.

29. The bow of claim 28 wherein each one of the multiple first power cable pulley arrangements results in one or more of: (i) a corresponding draw length of the bow that differs from a draw length resulting from at least one different first power cable pulley arrangement; (ii) a corresponding draw weight of the bow that differs from a draw weight resulting from at least one different first power cable pulley arrangement; (iii) corresponding stored energy of the drawn bow that differs from stored energy of the drawn bow resulting from at least one different first power cable pulley arrangement; or (iv) a corresponding dependence of draw force on draw distance of the bow that differs from a dependence of draw force on draw distance resulting from at least one different first power cable pulley arrangement.

30. A method for adjusting the bow of claim 29, the method comprising moving the first power cable pulley from a first one of the multiple first power cable pulley arrangements and substantially rigidly attaching the first power cable pulley to the first draw cable pulley in a second, different one of the multiple first power cable pulley arrangements, thereby altering one or more of the draw weight, the draw length, the stored energy of the drawn bow, or the dependence of draw force on draw distance.

31. The bow of claim 17 further comprising a second power cable, wherein:

(g) the second pulley assembly comprises a second draw cable pulley, a second power cable pulley substantially rigidly attached to the second draw cable pulley, and a second adjustable cable deflector substantially rigidly attached to the second draw cable pulley;

(h) the second draw cable pulley is structurally arranged so as to (i) define a second pulley assembly transverse rotation axis, (ii) be mounted on the second bow limb to rotate about the second pulley assembly axis, (iii) let out the draw cable from a circumferential draw cable journal of the second draw cable pulley when the bow is drawn and the second draw cable pulley rotates about the second pulley assembly axis, and (iv) provide a second power cable anchor;

(i) the second power cable pulley is structurally arranged and positioned on the second draw cable pulley so that (i) with the bow at brace and during an earlier phase of drawing the bow, the second power cable pulley does not make contact with the second power cable that is anchored at the second power cable anchor, (ii) during a later phase of drawing the bow, a segment of the second power cable that is displaced from the second power cable anchor is taken up by a circumferential power cable journal of the second power cable pulley, and a segment of the second power cable that is immediately adjacent the second power cable anchor does not make contact with the second power cable pulley;

(j) one or both of the second cable deflector and the second draw cable pulley are structurally arranged so as to enable substantially rigid attachment of the second cable deflector to the second draw cable pulley in any one of a set of multiple second deflector arrangements;

(k) in any one of the multiple second deflector arrangements, with the bow at brace, the second cable deflector causes no lateral deflection, or only negligible lateral deflection, of the second power cable; and (l) in one or more of the multiple second deflector arrangements, the second cable deflector is positioned and arranged so as to deflect laterally, during the later phase of drawing the bow, the adjacent segment of the second power cable by a non-negligible amount relative to an undeflected second power cable path between the second power cable anchor and the second power cable pulley, with the non-negligible amount of lateral deflection differing from an amount of lateral deflection of at least one other of the multiple second deflector arrangements.

32. The bow of claim 31 wherein:

(m) the first pulley assembly further comprises a first power cable let-out pulley substantially rigidly attached to the first draw cable pulley or the first power cable pulley;

(n) the first power cable let-out pulley is structurally arranged so as to let out from a circumferential power cable journal of the first power cable let-out pulley the second power cable when the bow is drawn and the first draw cable pulley rotates about the first pulley assembly axis;

(o) the second pulley assembly further comprises a second power cable let-out pulley substantially rigidly attached to the second draw cable pulley or the second power cable pulley; and (p) the second power cable let-out pulley is structurally arranged so as to let out from a circumferential power cable journal of the second power cable let-out pulley the first power cable when the bow is drawn and the second draw cable pulley rotates about the second pulley assembly axis.

33. The bow of claim 17 wherein the second pulley assembly includes a power cable let-out pulley that is structurally arranged so as to let out from a circumferential power cable journal of the power cable let-out pulley the power cable when the bow is drawn and the draw cable pulley rotates about the first pulley assembly axis.

34. The bow of claim 17 wherein:

(g) the first pulley assembly further comprises a draw cable let-out pulley substantially rigidly attached to the first draw cable pulley or the first power cable pulley;

(h) the second pulley assembly comprises an idler wheel; and (i) the draw cable let-out pulley is structurally arranged so as to let out from a circumferential draw cable journal of the draw cable let-out pulley the second end of the draw cable, with the draw cable passing around the idler wheel, when the bow is drawn and the draw cable pulley rotates about the first pulley assembly axis.

35. The bow of claim 17 further comprising a coupling cable, wherein:

(g) the first pulley assembly further comprises a coupling cable let-out pulley substantially rigidly attached to the first draw cable pulley or the first power cable pulley;

(h) the second pulley assembly comprises a second draw cable pulley and a coupling cable take-up pulley;

(i) the second draw cable pulley is structurally arranged so as to let out from a circumferential draw cable journal of the second draw cable pulley the draw cable when the bow is drawn and the second pulley assembly rotates about the second pulley assembly axis;

(j) the coupling cable take-up pulley is structurally arranged so as to take up into a circumferential coupling cable journal of the coupling cable take-up pulley a first end of the coupling cable when the bow is drawn and the second pulley assembly rotates about the second pulley assembly axis; and (k) the coupling cable let-out pulley is structurally arranged so as to let out from a circumferential coupling cable journal of the coupling cable let-out pulley a second end of the coupling cable when the bow is drawn and the first draw cable pulley rotates about the first pulley assembly axis.

* * * * *